United States Patent [19]

Gibb

[11] Patent Number: 4,558,744

[45] Date of Patent: Dec. 17, 1985

[54] SUBSEA CAISSON AND METHOD OF INSTALLING SAME

[75] Inventor: Peter R. Gibb, Port Coquitlam, Canada

[73] Assignee: CanOcean Resources Ltd., Canada

[21] Appl. No.: 531,682

[22] Filed: Sep. 13, 1983

[51] Int. Cl.[4] ..... E21B 7/18

[52] U.S. Cl. ..... 166/335; 166/356; 166/222; 175/217; 175/422 R; 405/226

[58] Field of Search ..... 166/342, 344, 345, 350, 166/356, 362, 364, 366, 222, 223; 405/8, 224, 226; 175/217, 422

[56] References Cited

U.S. PATENT DOCUMENTS

| | | | |
|---|---|---|---|
| 1,465,664 | 8/1923 | Griesser | 166/356 |
| 2,475,888 | 7/1949 | Hackett . | |
| 3,344,612 | 10/1967 | Rininger . | |
| 3,380,256 | 4/1968 | Rebikoff . | |
| 3,673,716 | 7/1972 | Trondle . | |
| 3,783,626 | 1/1974 | Hansen | 405/226 |
| 3,796,273 | 3/1974 | Rininger . | |
| 3,805,534 | 4/1974 | Brasted . | |
| 4,123,858 | 11/1978 | Batchelder . | |
| 4,127,950 | 12/1978 | Tillinghast et al. . | |
| 4,180,349 | 12/1979 | van Bilderbeek | 405/224 |
| 4,253,255 | 3/1981 | Durell . | |
| 4,307,525 | 12/1981 | Mabloblocki . | |
| 4,334,584 | 6/1982 | Magill | 405/226 |

FOREIGN PATENT DOCUMENTS

| | | |
|---|---|---|
| 282820 | 8/1928 | United Kingdom . |
| 654039 | 5/1951 | United Kingdom . |
| 893167 | 4/1962 | United Kingdom . |

OTHER PUBLICATIONS

Using Air and Water to Assist Piling and Anchoring Offshore, by N. Kerr (pp. 33–42) (Paper No. C126/76).

The Hydropin: A New Concept in Mooring, by N. Kerr, Reprinted from Transactions, vol. 92, No. 2, North East Coast Institution of Engineers and Shipbuilders.

A Self-Burying Anchor of Considerable Holding Power, by N. Kerr, Paper No. OTC 2466, Offshore Technology Conference, pp. 447–453.

Vetco Technical Bulletin VTB 2–55, Cameron Oil Tools Publication 1981.

*Primary Examiner*—Stephen J. Novosad

*Assistant Examiner*—William P. Neuder

*Attorney, Agent, or Firm*—Burns, Doane, Swecker & Mathis

[57] ABSTRACT

A subsea caisson or silo for housing wellhead equipment and methods of installing it is disclosed. A caisson which is sized to receive equipment that is to remain subsea has a closed top and open bottom. The caisson is lowered to the seabed and hydrostatic pressure in combination with a suction jet is used to remove the internal soil. If required the caisson may include a conical suction head located near the bottom of the caisson wall and rotatable cutting heads are fixed to its lower surface so as to cut into sea bottom material of hard consistency.

14 Claims, 47 Drawing Figures

SUBSEA CAISSON AND METHOD OF INSTALLING SAME

FIELD OF THE INVENTION

This invention relates to subsea caissons or silos for housing wellhead equipment and to protect that equipment from damage by ice, anchors, fishing gear or any other object in contact with the sea bed.

BACKGROUND OF THE INVENTION

Protection of subsea wellheads is a technology that is in its infancy. The use of large diameter subsea caissons have been tried in the past for Artic areas, but have been generally unsuccessful mainly due to installation problems. The practice of dredging "glory holes" is currently used but is expensive and does not protect equipment from scour debris. Piled frameworks have been used for protection against fishing gear and anchors but again they are large, difficult to install and expensive. Recently the industry has been developing insert tree systems, with the intent of reducing the quipment size so that it can be housed inside a conductor pipe. Although this approach meets many primary requirements it also introduces reliability severe and maintenance problems.

Conventionally, therefore, subsea wells have the wellhead at the sea bed and have connected to them either a blowout preventer during the pulling phase or a valve block assembly and flow line connector during the production phase. The wellhead and the associated equipment project somewhat above the sea bed and are thus vulnerable to damage.

All equipment on the ocean floor is at risk due to a variety of hazards. In offshore hydrocarbon developments to date, the major hazards to subsea equipment are from trawlboards used in commerical fishing and from anchors used by supply boats, laybarges, drill ships, etc. For hydrocarbon development in cold water regions, a new hazard which must be considered is ice scour of the sea bottom. For example in the Beaufort Sea area, ice scouring occurs in the region beyond landfast ice where ice ridges are formed and frequently scour the seabed. Off the east coast of Canada very deep scours can occur when an iceberg grounds out. Therefore there is a requirement for a well completion design that will maintain control over the well even in the extreme event of an ice scour shearing off the top of the well.

One conventional solution consists of placing pressure control devices (such as master valves, DHSV's, etc.) and the wellheads with their sealing systems below the scour zone together with suitable shear devices to insure their integrity. There are many alternate ways to implement such a solution. One method is to excavate a large glory hole with sufficient depth to place all well control devices below the scour line. The glory hole approach is a good technical solution but is not economically attractive. The other end of the spectrum of solutions, is to design compact Xmas trees that can be installed inside the well bore to the required depth with sacrificial equipment above the well control devices. The insert tree has been developed to minimize equipment heights above the mudline but it is unknown whether the equipment between the surface and the well control devices is sacrificial.

However, between the two extremes described above, there are a number of other solutions available.

They basically consist of installing a caisson large enough to allow a conventional subsea tree to be installed inside the caisson. The success of this approach depends on the feasibility of installing the caissons.

The insert tree evolved from a need to protect subsea wellheads from snagged anchors and trawlboard impacts. One protection method that has been tried is to install protective covers that divert, deflect, or snag fishing gear and anchors. These structures are large and expensive to install beacuse of the height of trees above mudline. Therefore, compact trees were developed to reduce the wellhead profile. This leads to the development of the insert tree which places the complete tree assembly inside the wellbore with only the flowline connection protruding above the mudline.

One company has developed a tree that will fit into a 30 inch casing. It uses ball valves and inline operators to keep the valve assembly inside the 30 inch diameter. Another company offers an insert tree that uses gate valves and in-line operators but requires a 40 inch casing.

The main advantage of the insert tree is that the basic drilling procedures are not affected. The structural casing run into the hole will require a casing hanger at the required elevation to receive the wellhead. Special running tools and a temporary wellhead extension will also be required. Except for these special tools and equipment, standard drilling practices can be used.

The main disadvantage of the insert tree is some loss in operational flexibility: no in-situ repair or inspection of master valve block and operators is possible. The equipment must be retrieved for all levels of repair. Direct surface well access is not possible except by first removing the flowline extensions. TFL systems must be relied upon as a primary method of well bore access. Wing valves have not been incorporated in the current design of insert trees. Therefore, normal shut-in practice will be to stop the flow with a surface valve to avoid excessive wear on the master block valve. Placement of compact valve assemblies in restricted confines could complicate installation, retrieval, and well killing operations. Blowout preventers are still exposed during the drilling phase and, because the production tubing exits through the top of the casing, the wellhead assembly still protrudes significantly above the mudline, probably six or seven feet.

To overcome some of these problems, it has been proposd to make a caisson large enough to contain the blowout preventer. U.S. Pat. Nos. 3,344,612 and 3,796,273 describe methods of installing such a caisson type. U.S. Pat. No. 3,344,612 uses a jetting technique for caissons installed in a soft sea bed and U.S. Pat. No. 3,796,273 uses a rotary drilling technique for hard sea bed. In this latter arrangement, the base of the caisson has cutting teeth on its surface and the complete caisson is rotated thereby boring its own hole. Although these techniques appear feasible, they require a drilling rig which is very expensive and must rely on cementing to ensure their soundness since the surrounding soil is highly disturbed. In the case of the rotating caisson, the feasibility of easily rotating such a large body when it nears its full penetration is questionable since there is a large surface area at a large radius.

U.S. Pat. No. 3,380,256 proposes putting a complete drill rig in a caisson and sinking it by means of hydrostatic pressure. In this patent, the caisson skirt is pushed into the sea bed until the base of the caisson contacts the sea bed with the result that part of the caisson with the wellhead equipment still protrudes above the sea bed. The technique of using hydrostatic pressure described in this patent has been used successfully in sinking suction anchors. The main limitation is the depth of penetration obtainable before the soil-resisting force balances the force produced by the hydrostatic pressure.

SUMMARY OF THE INVENTION

The present invention overcomes many of the problems mentioned above relative to current caissons and their method of installation by retaining conventional subsea tree and wellhead systems and providing efficient and cost effective methods of sub-mudline installations. In the present invention, the caisson is sized to suit the equipment that is to remain subsea and is installed by reducing pressure inside the caisson. This creates a hydrostatic pressure differential between the inside and outside of the caisson resulting in a positive downward force that overcomes soil resistance and drives in the silo. The submerged weight of which creates an initial seal. The soil plug inside the caisson is removed either while the caisson is being run in or after it has reached its correct depth. A base to the caisson is then installed. The installation of the base after the caisson is at its desired depth and thus allowing the caisson to be installed in a similar manner as a suction anchor, means that the installation can be done by a normal work boat rather than an expensive drill rig and does not tie up the drill rig if problems occur. Furthermore, the caisson is firmly installed in the sea bed and does not require additional cementing.

A blowout preventer can be located inside the caisson if a large enough diameter is selected. For a caisson sized to accept a production tree only, the wellhead must be extended to the mudline. The extension spool would support the weight of the BOP but side loads would be removed at the mudline and transmitted into the top of the silo.

Soil data must be obtained to determine the optimum installation method and caisson size in some areas, the sea bed may provide too much resistance and prevent full penetration using only hydrostatic pressure. If this occurs, a rotatable cutting device is utilized on the lower peripheral wall of the cylindrical body of the caisson. Inasmuch as no base closure is initially used on the caisson body, the cutter only has to remove a small amount of subsea soil required for the caisson walls to pass through. The caisson is not rotated but only the cutter so the torque required is considerably reduced over the conventional method referred to above and the hydrostatic pressure again is used to overcome vertical soil resistance.

The current method of drilling subsea wells in a cluster is to use a subsea template which is a structure placed on the sea bed that has holes or slots in it to accept wellheads. The template is usually plowed to the seabed and levelled. U.S. Pat. No. 3,796,273 uses the idea of a template for multiple wells by setting the caissons into a template.

According to the present invention, a number of caissons are joined together without the need for a template and the complete assembly is installed as an integral unit using hydrostatic pressure on each chamber. Should the addition of a soil cutter be required, the cutter described above for the single caisson is directly applicable to multiple units. The installation does not have to be manifolded but can be an option.

Preferably, the subsea soil on the interior of the caisson is removed as the caisson is being installed since this eliminates the soil friction on the inside of the caisson wall and permits deeper caisson penetration. One method is to provide a jetting device extending inwardly from the top cover to the lower end of the caisson and being directed downwardly therein. In this method, the soil is fluidized by the inwardly coming jet of water and is removed with the water through suction pumps, the inlet to which is situated coaxially in a detachable cover of the caisson body. In another embodiment, a plurality of jetting nozzles can be located adjacent the lower circumferential rim of the caisson body so that they not only assist the caisson wall penetration and effect the loosening of the inside soil but they are also directed angularly inwardly to prevent the jet of fluid and loosened soil from washing up on the outside of the caisson wall. This ensures that the outside of the caisson is firmly held by surrounding subsea soil.

Caisson systems proposed to date have not used a method of flowing the well to another facility or they suggest using flow lines exiting through the top of the caisson to a normal above-mudline connection method. The present invention utilizes a flowline connection port on the upper side wall of the caisson so that the flowlines can be connected below the mudline out of harm's way. Such a port can be equipped with a jetting device to wash soil away from the outside of the port and the flowline bundle as it is being pulled in.

Another embodiment disclosed in the present invention provides a permanent base having a rotatable cutter head mounted on the inside of the caisson wall adjacent the lower end thereof. The caisson consists of a large diameter, elongated cylinder having a fluid jetting manifold ring and a conical suction, cutter head mounted adjacent the lower end of the cylinder. The suction cutter head is supported on radially located bearing means on the inner perimeter of the cylinder so as to allow the suction head to rotate relative to the wall of the caisson. Seal means prevents excessive leakage of pressure and material from the suction cylinder portion of the caisson to the back fill cylinder portion.

Radially spaced steel cutting heads are fixed to the bottom of the conical cutter head surface in a spiral pattern to affect the cutting and transporting action to the sea bed material, directing it to the center of the caisson. A back fill tube mandrel and conductor guide tube is provided at the center of the suction head to which a backfill prevention tube is connected. This tube prevents material from below the head from backfilling the caisson and acts as a torque tube to transmit power from motor means located on the caisson installation tool.

The permanent base in the silo prevents fluidized soils from filling the silo from underneath due to the head of soil on the outside. With the silo in place, the installation equipment can be removed and is reusable. This equipment includes suction and jetting pumps, suction head and piping, motor and drive for turning the base and the top cover. The seal and rollers which allow the base to rotate are low cost items and are not recovered.

The present invention utilizes a removable top closure which allows several tops to be used, depending on the circumstances of installation and use. The top with the suction pumps and associated equipment can be removed after the caisson is installed and used on other installations. After the production equipment is installed on the caisson, at least two alternative tops can be fitted.

If the equipment is to be used wet, i.e. to be accessed by divers, then a light debris protection cover is used. On the other hand, if a dry, one-atomosphere installation is required, then a cover suitable for resisting hydrostatic pressure is installed and which would have a marine mating surface and hatch suitable for use by diving bells or submarines to land on and transfer people to the interior of the caisson.

According to one broad aspect, the invention relates to a method of securing the caisson in the seabed, the caisson having a detachable top cover and an open bottom, the method comprising the steps of; providing jet and suction means within the confines of the caisson; lowering the caisson to the seabed surface so that the peripheral open bottom wall of the caisson engages the surface of the seabed; orienting the jetting device toward the lower end of the caisson and actuating the same to fluidized soil within the caisson and removing said soil and jetting fluid via suction means whereby the caisson is lowered into said seabed by hydrostatic pressure so that the top of the caisson is below the scour line; and removing the cover, jet and suction means.

According to another broad aspect, the invention relates to a caisson for installation in a seabed comprising an elongated cylindrical housing having an open bottom and replaceable top closure, means in the top closure are provided for the entry of jetting and suction means for removing subsea soil from within the caisson so as to lower it by hydrostatic pressure; and means are provided on the inner wall of said caisson for locking and sealing a permanent base therein.

BRIEF DESCRIPTION OF THE DRAWINGS

The invention is illustrated by way of example in the accompanying drawings in which.

DESCRIPTION OF THE PREFERRED EMBODIMENTS

There are a variety of ways in which a subsea caisson can be installed. The most obvious method is to drill, using the same drill rig that will eventually drill the well. While this would save the cost of mobilizing a special vessel and would utilize the capability already on site, an offshore drill rig has a very high day rate. Accordingly, an installation method which requires very little surface support equipment and can be readily mobilized to go offshore and complete the caisson installation prior to the drill rigs, has great potential.

The main advantage of using a suction technique as disclosed herein for caisson installation is that the surface support equipment required is minimal compared to other methods. The installation requires a work boat with a crain or A-frame capable of handling the caisson and lowering it to the seabed. The operation can be completed before a drill rig arrives on site.

Figure 1:
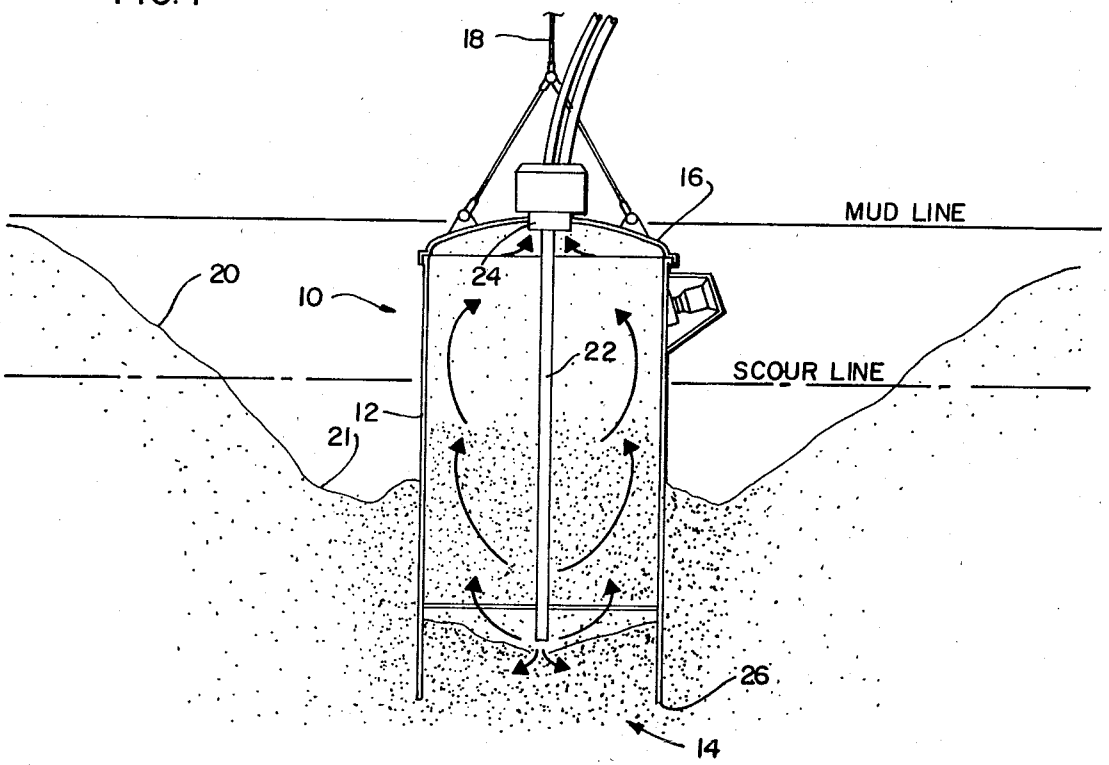
FIGS. 1 and 2 are elevation drawings showing one embodiment of installing a caisson in subsea soil.
Figure 2:
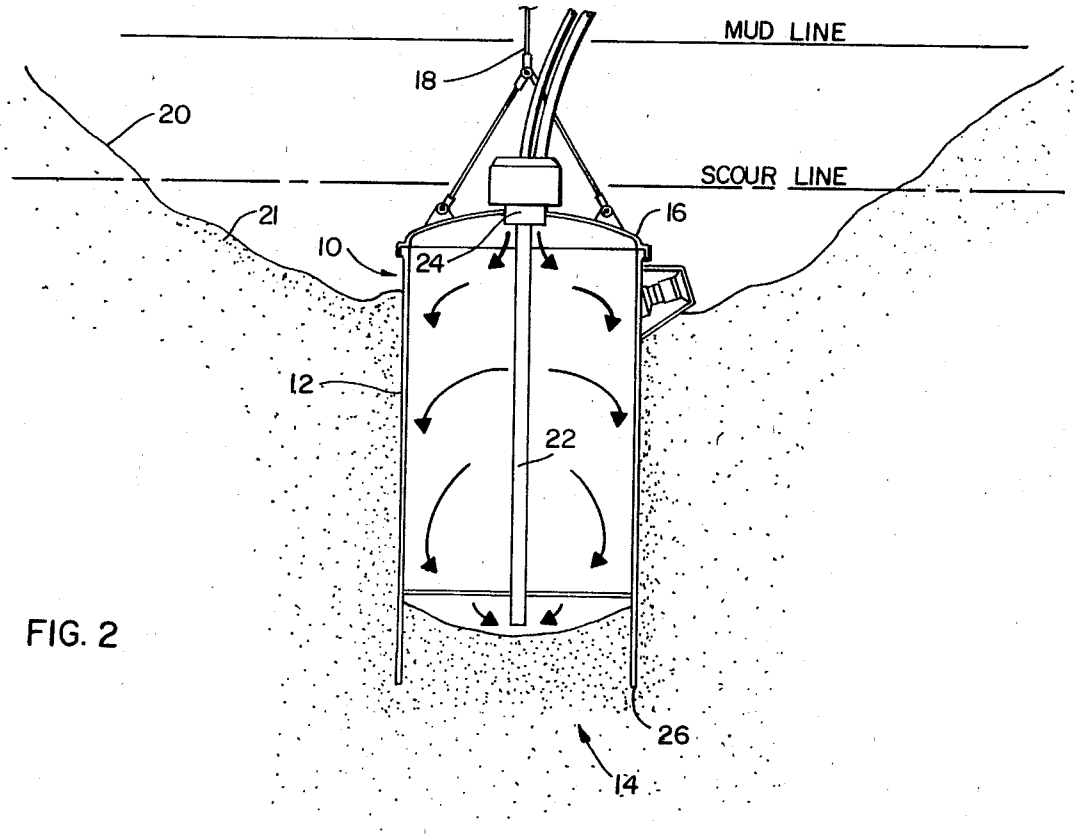
Figure 3:
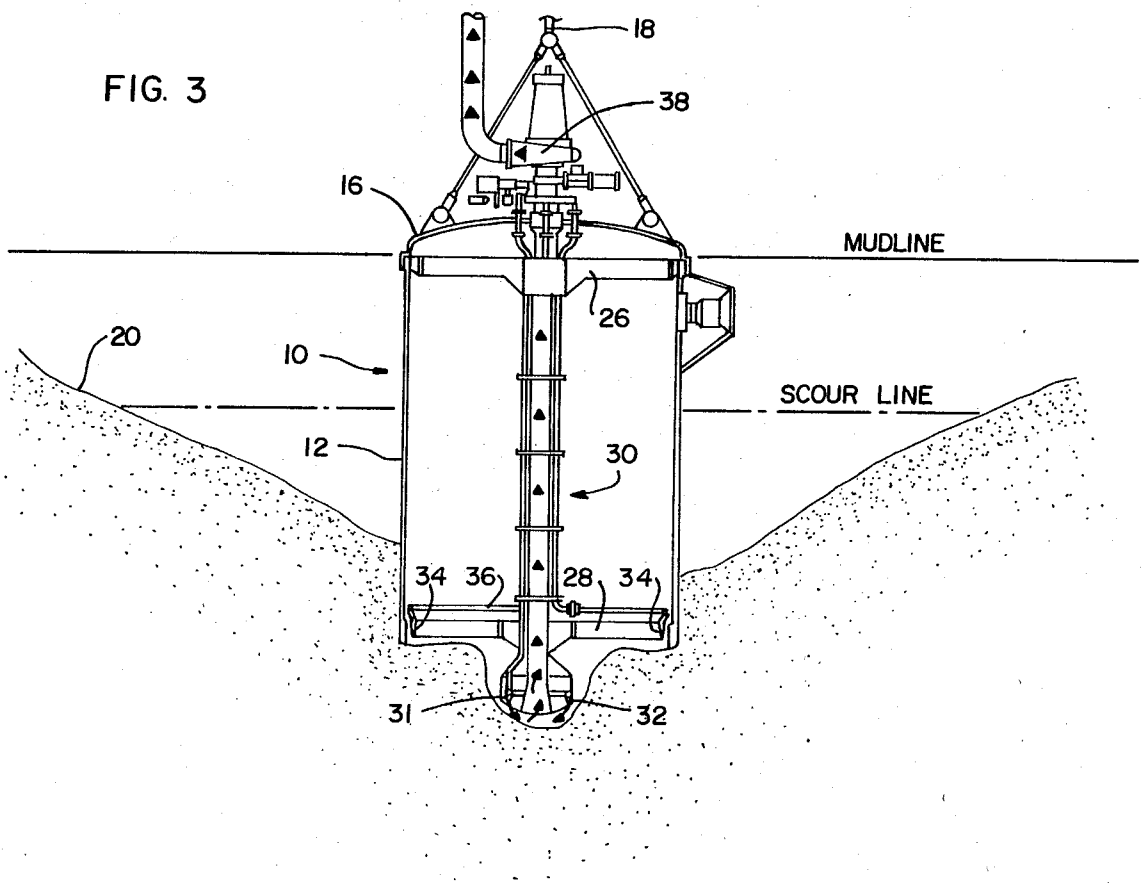
FIGS. 3 through 17 inclusive are sequential drawings showing further embodiment of the present invention.

Referring to FIGS. 1 and 2, a subsea caisson 10 has an elongated cylindrical body with a continuous curved wall 12, an open bottom 14 and a top closed by a replaceable cover 16. The top 16 is secured to cables or the like 18 for lowering the caisson 10 to the seabed 20. The lower peripheral edge 26 of the caisson engages the surface of the seabed in the glory hole 21 and the subsea soil within the confines of the caisson is fluidized by the incoming water from jets 22 and 24. When the caisson is at the required depth as shown in FIG. 2, the jet 22 and suction inlet 24 are reversed so that the material is removed from the interior of the caisson and is evacuated by a vacuum pump in a mother ship thereby causing the ambient water pressure to assist in driving the caisson to its position on the sea bottom as shown in FIG. 2.

Figure 4:
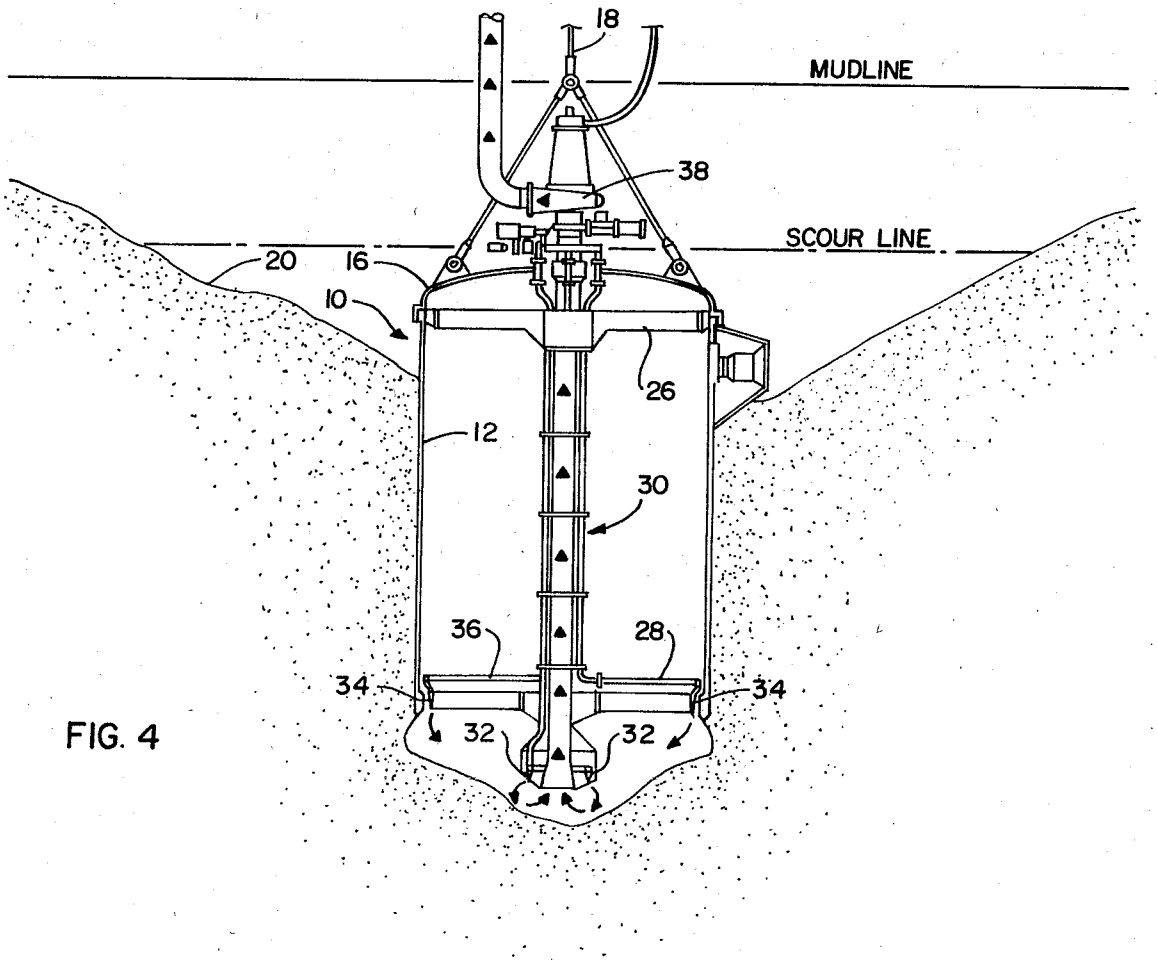

Referring now to the sequence in FIGS. 3 through 17, the caisson 12 is lowered to the seabed 20 from a work boat or barge by means of the cable 18 secured to the top 16 of the caisson. The caisson partially penetrates the seabed 20 under its own weight. A pair of collars 26, 28 are located at the upper and lower ends of the caisson wall 12 and a jetting-vacuum arrangement indicated generally at 30 is positioned therein. This jetting arrangement includes a plurality of centrally located jets 32 on the suction head 31 to ensure the correct proportion of water and soil enters the suction pipe. Additionally a plurality of perimeter jets 34 are interconnected to a manifold 36 so that they can be more or less individually actuated to produce a moment to correct caisson inclination if such is required. As the jets 32 and 34 and the suction pump 38 is actuated, hydrostatic pressure together with the weight of the caisson causes the latter to reach its required depth as shown in FIG. 4. The cover 16 and suction equipment 30 are then removed as shown in FIG. 7.

Figure 6:
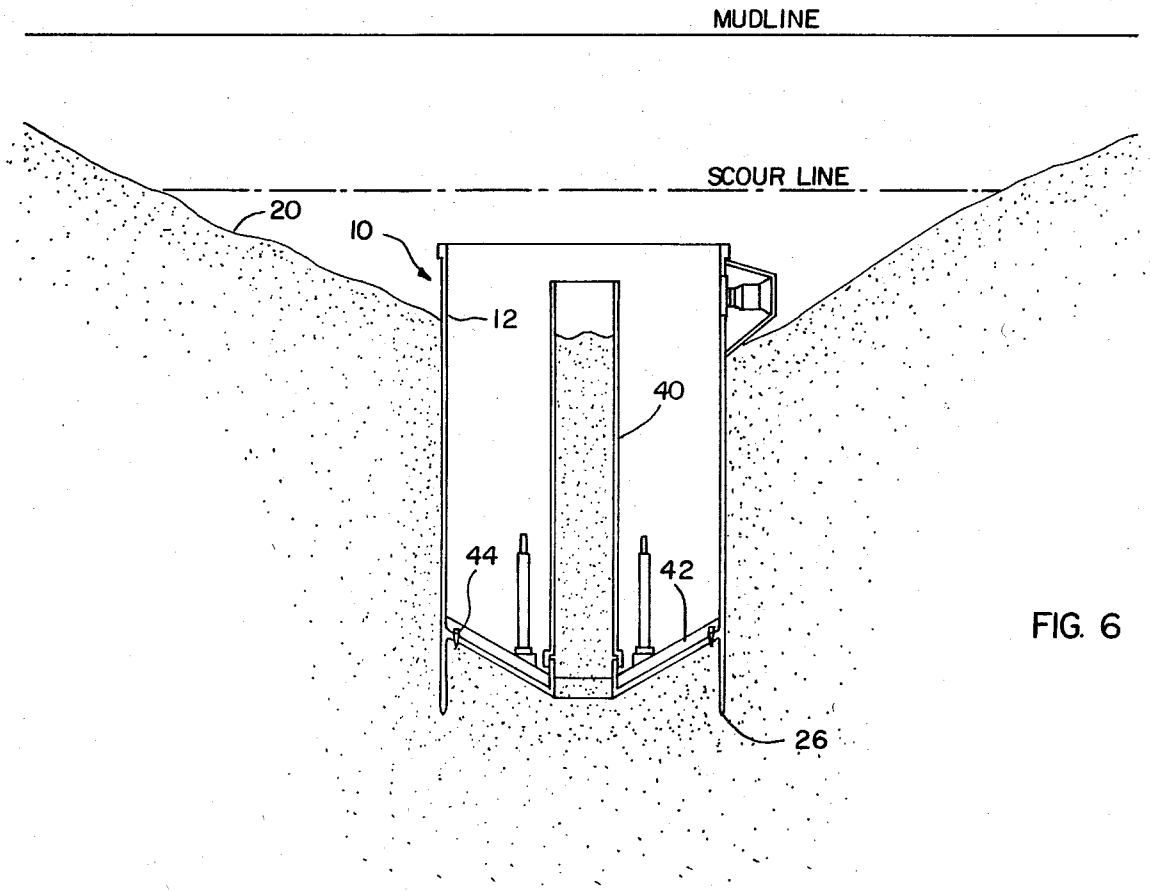
Figure 7:
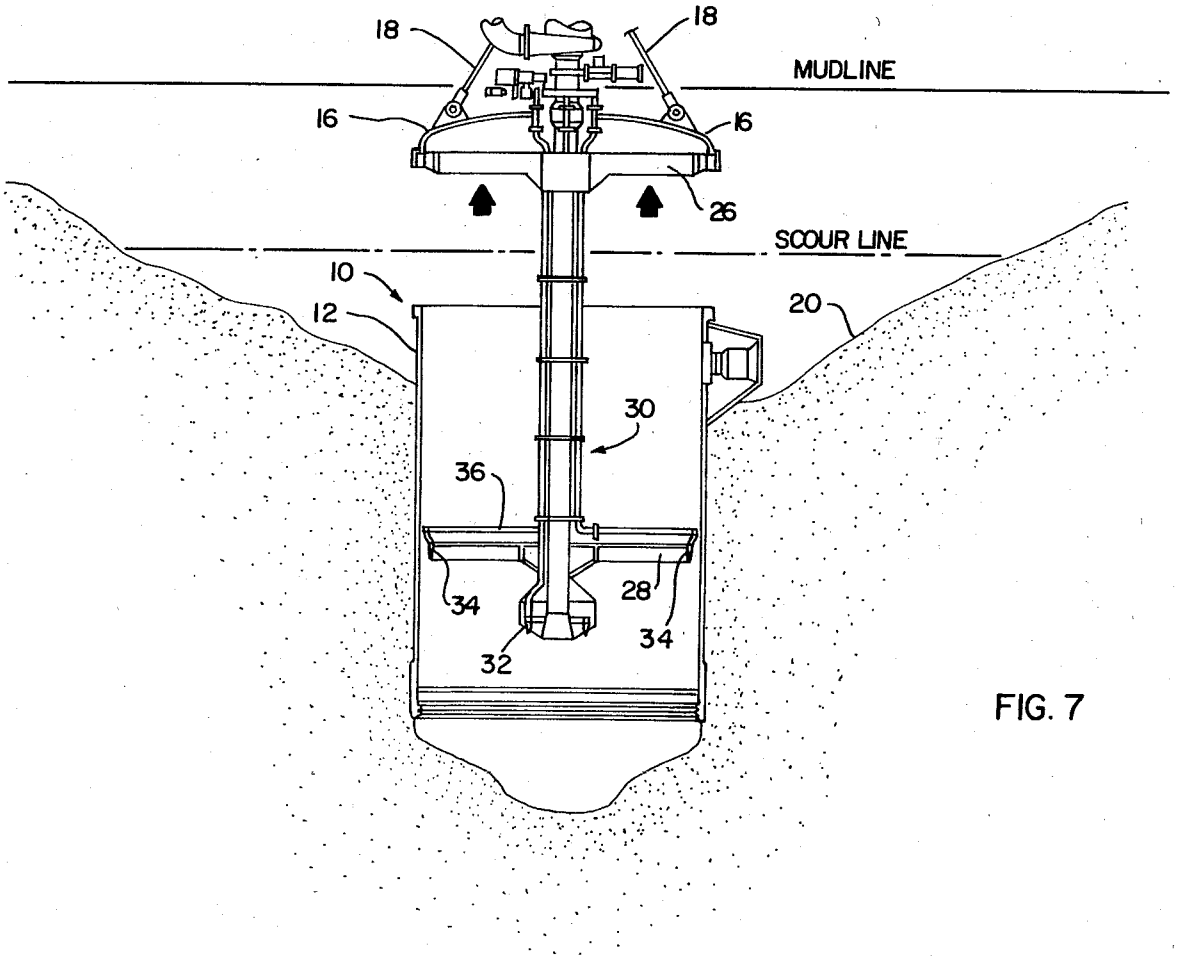
Figure 8:
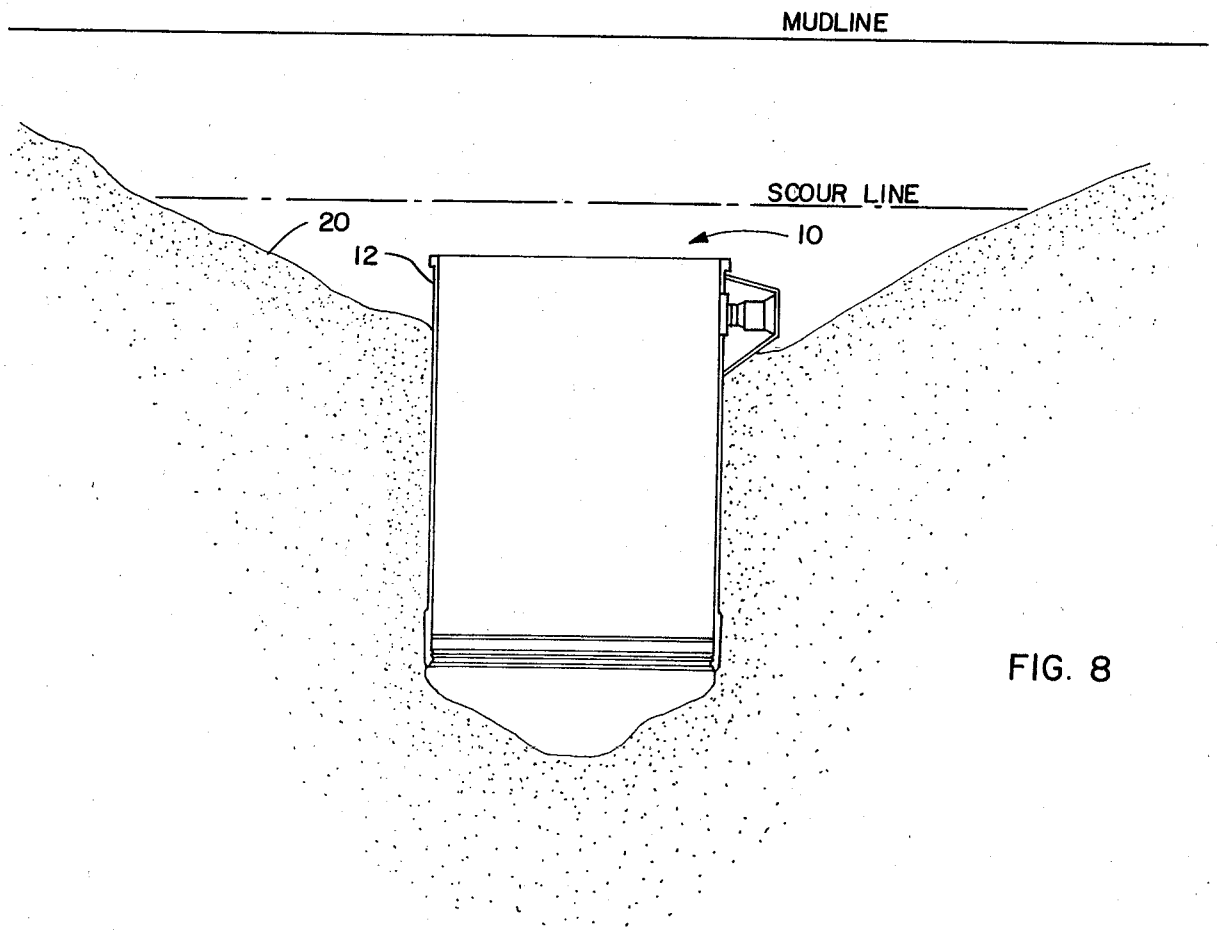

After the caisson 10 has been installed using the suction technique, the base will be open to the subsea soil as shown in FIG. 7, either totally if the caisson is installed without the base or partially if the base is intregal with the silo. Some soil types maybe so loosely compacted that their own weight will cause them to flow through the opening at the bottom of the caisson 10. In this situation, an intregal base caisson would be used as shown in FIGS. 5 and 6.

Figure 5:
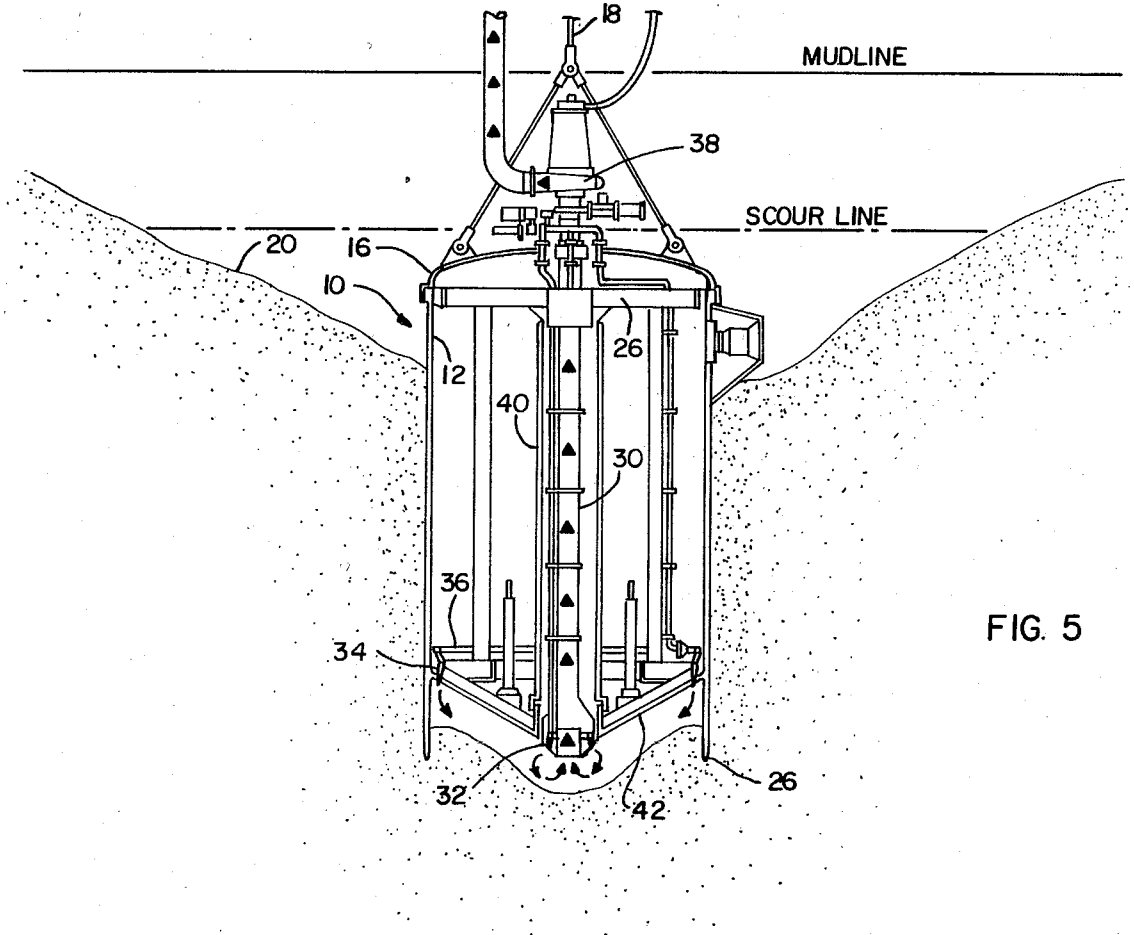

Although some form of temporary mechanical closure could be used such as a valve or flap, to cover the aperture, simpler and more perferred solution would be to use a vertical extension as shown in FIGS. 5 and 6 so that the soil will enter the extension only and thus provide a pressure balancing cone. Drilling for the conductor is then done through the extension. When the conductor is landed and locked into the base, the extension can be moved.

FIG. 5 shows a caisson 10 being installed with an extension pipe 40 in place, connected to a base 42 which in turn is connected to the inner wall 12 of the caisson at 44, adjacent its lower edge. As the subsea soil is fluidized below the bottom 42 of the caisson, the soil is drawn up through the apparatus 30 to the pump 38, all within the vertical extension 40. When the suction installation equipment 30 is removed as shown in FIG. 6, the extension 40 remains. A temporary guide will then be required to locate the drill string into the extension.

Figure 9:
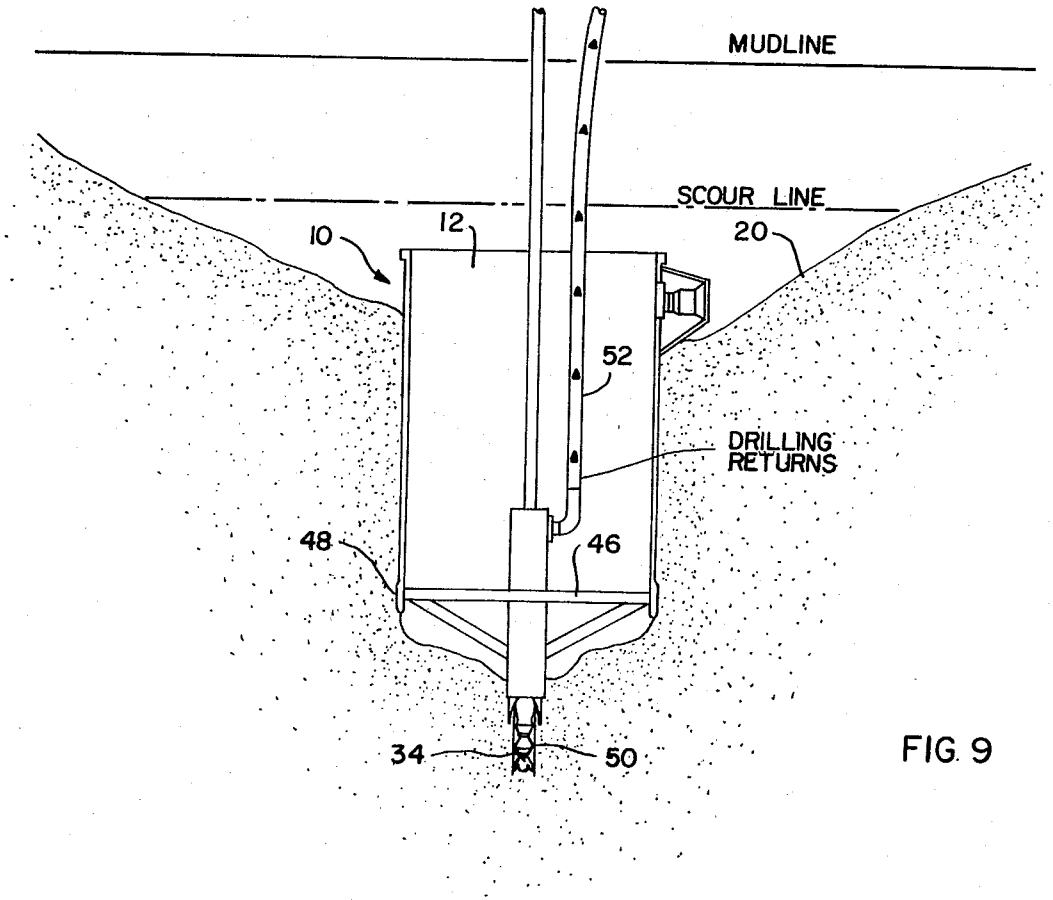
Figure 10:
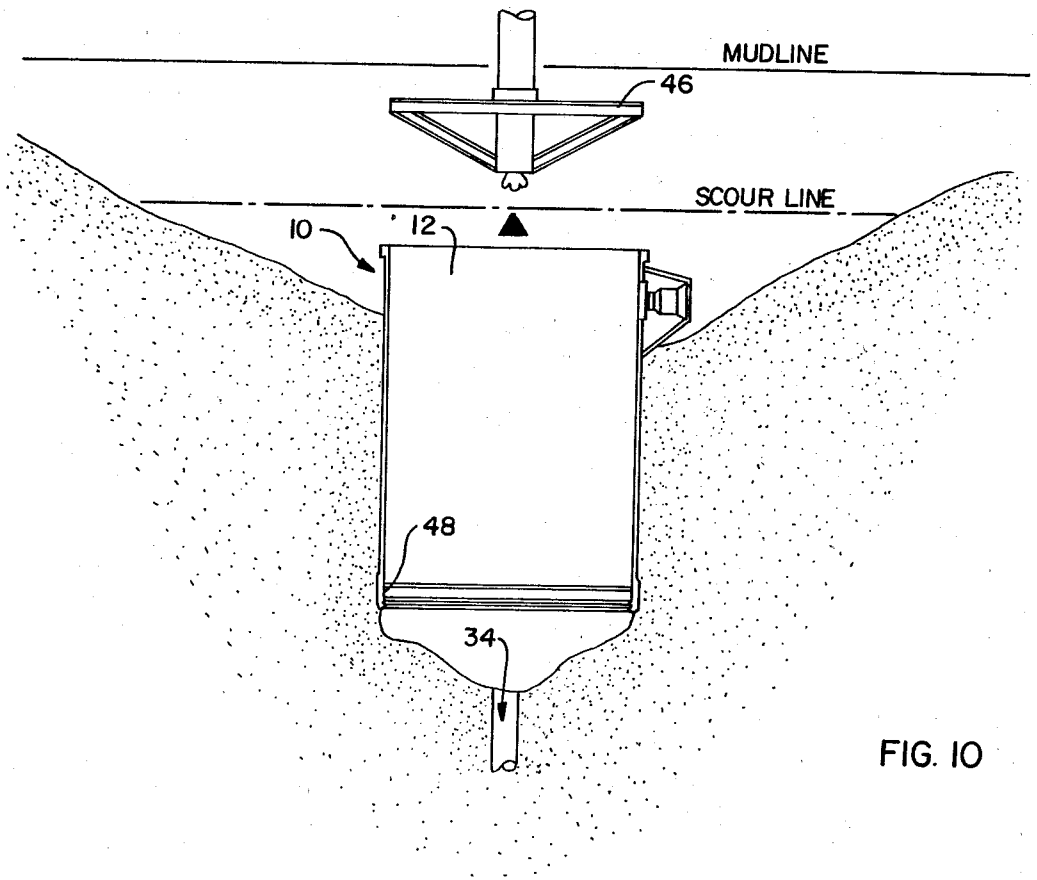
Figure 11:
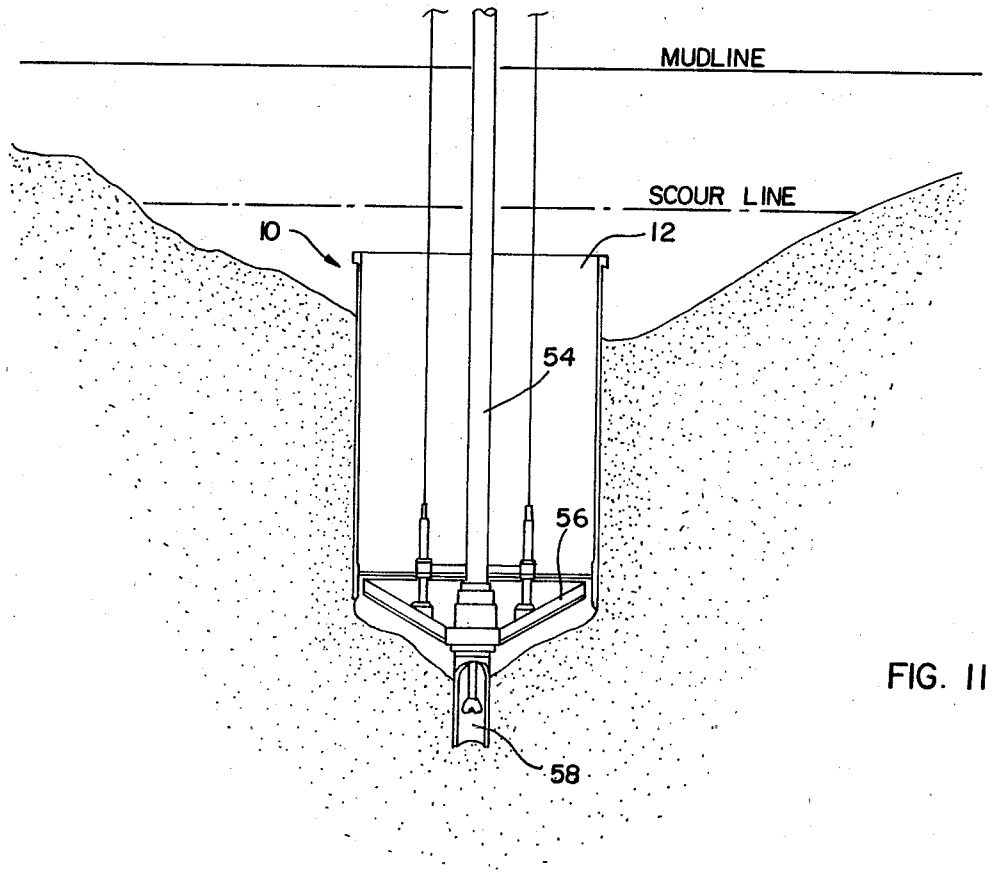

With the caisson 10 installed and flushed it is now ready to receive the drill rig and, as shown in FIG. 9, a temporary drilling guide 46 is then lowered into the confines of the caisson 10, the guide 46 resting on an inwardly directed, circumferential lip 48 on the inside of the caisson wall 12 adjacent its lower end. A drill bit and reamer 50 is then lowered through the guide 46 and hole 34 can be drilled for a conductor of given size. The drilling returns are drawn upwardly through a return pipe 52 and the temporary guide 46 is then removed as shown in FIG. 10 and the caisson 10 can be flushed and cleaned.

Figure 12:
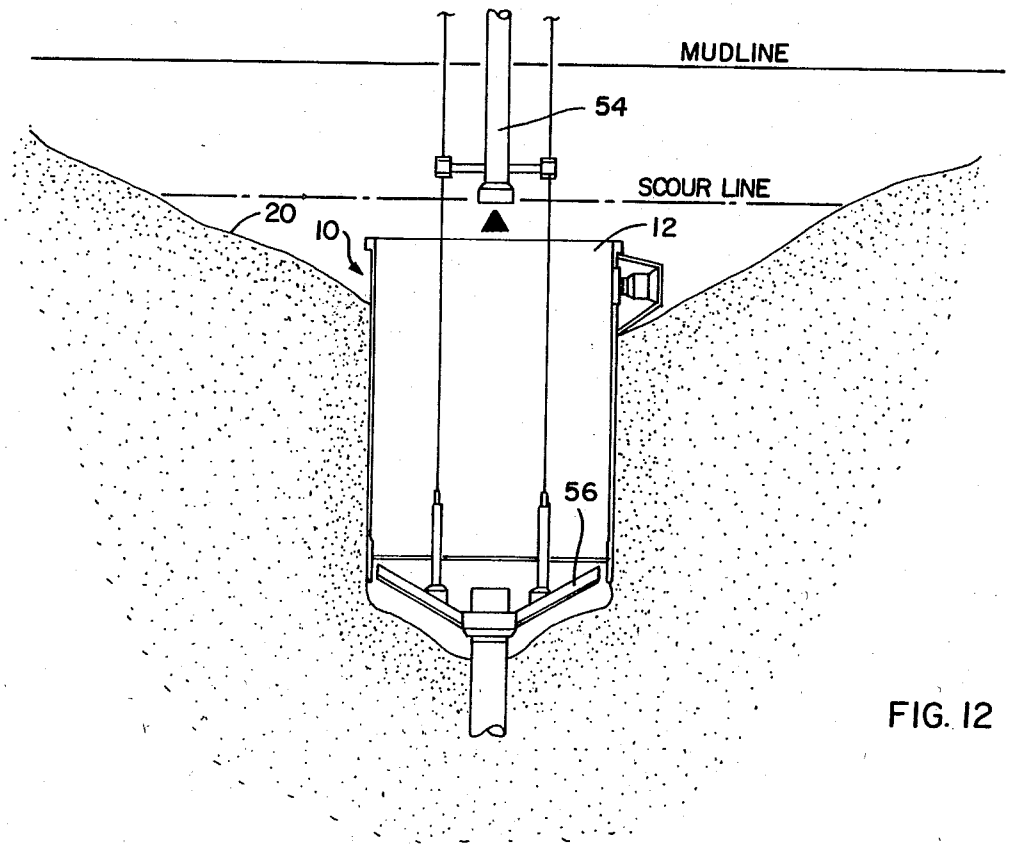
Figure 13:
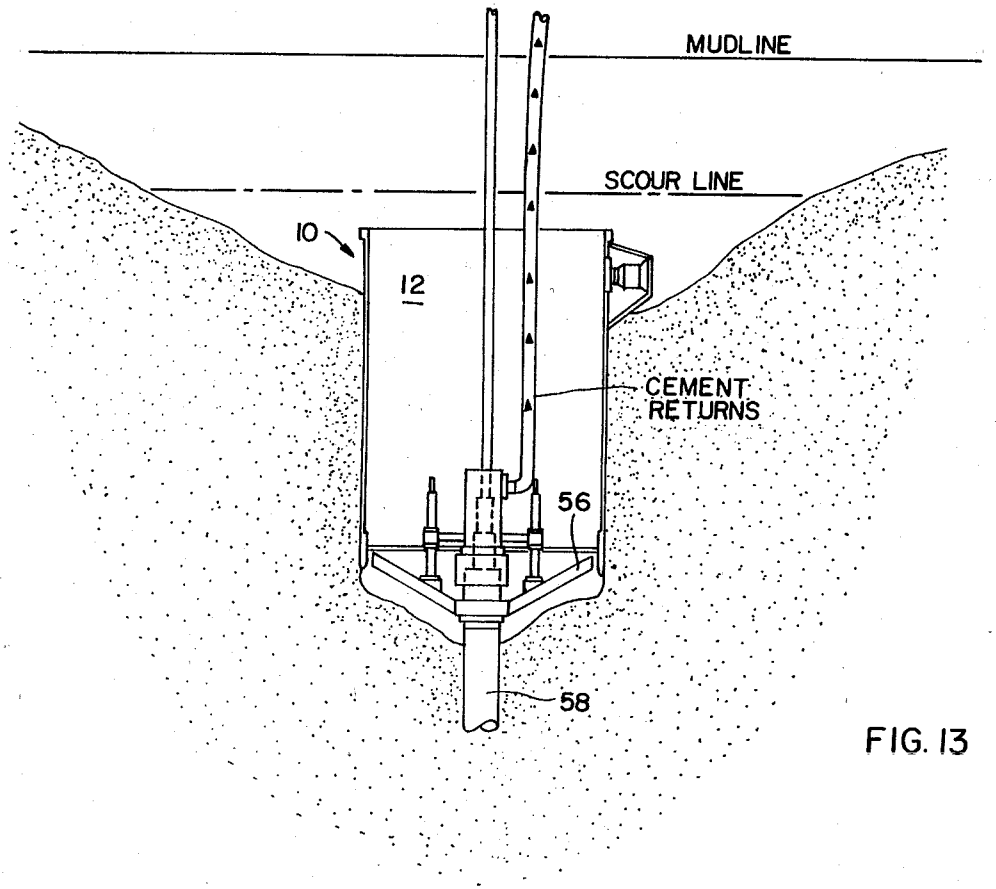
Figure 14:
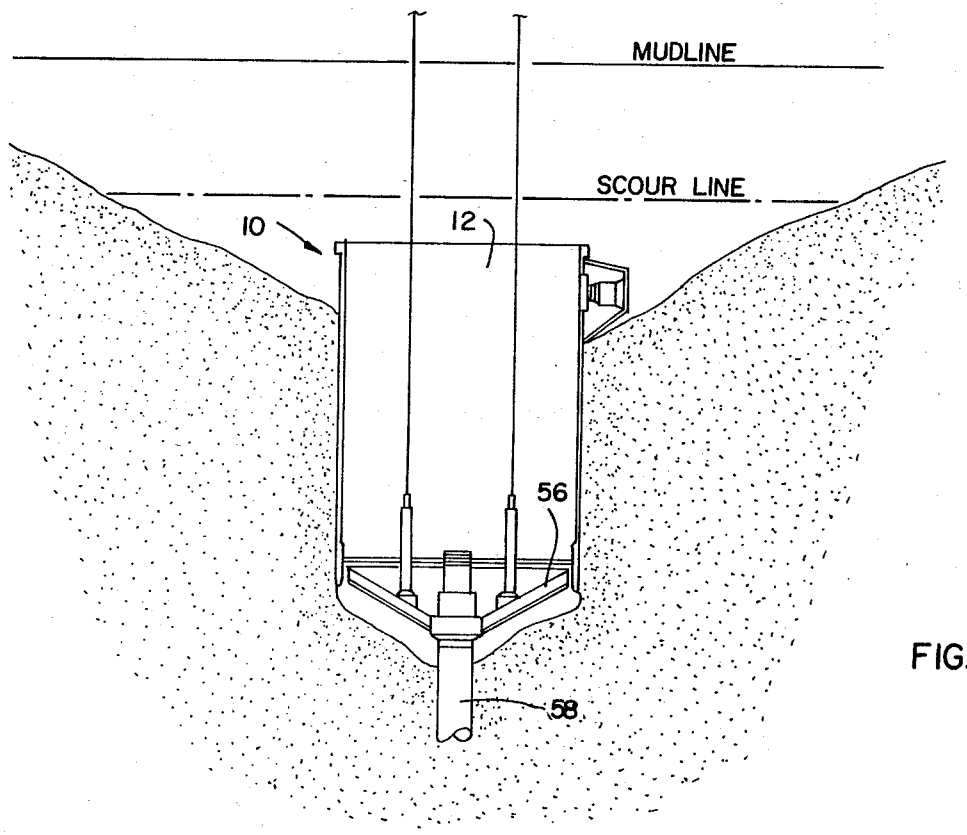

An outer conductor 54 and a permanent guide base 56 are then landed in the interior of the caisson 10 and the hole is drilled for a larger casing 58, the returns going through a separate pipe to the surface. The connector is then retrieved as shown in FIG. 12 and the casing 58 is cemented as shown in FIG. 13 to provide a marine wellhead illustrated in FIG. 14.

Figure 16:
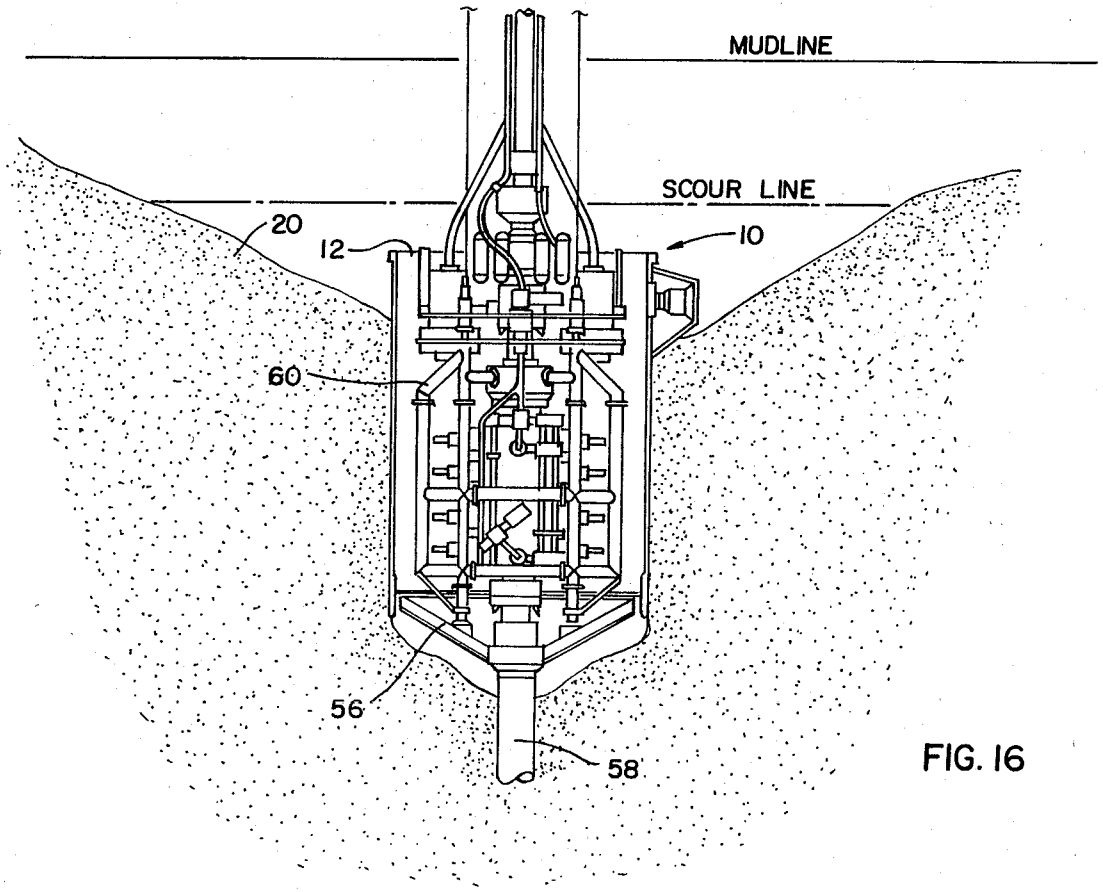
Figure 17:
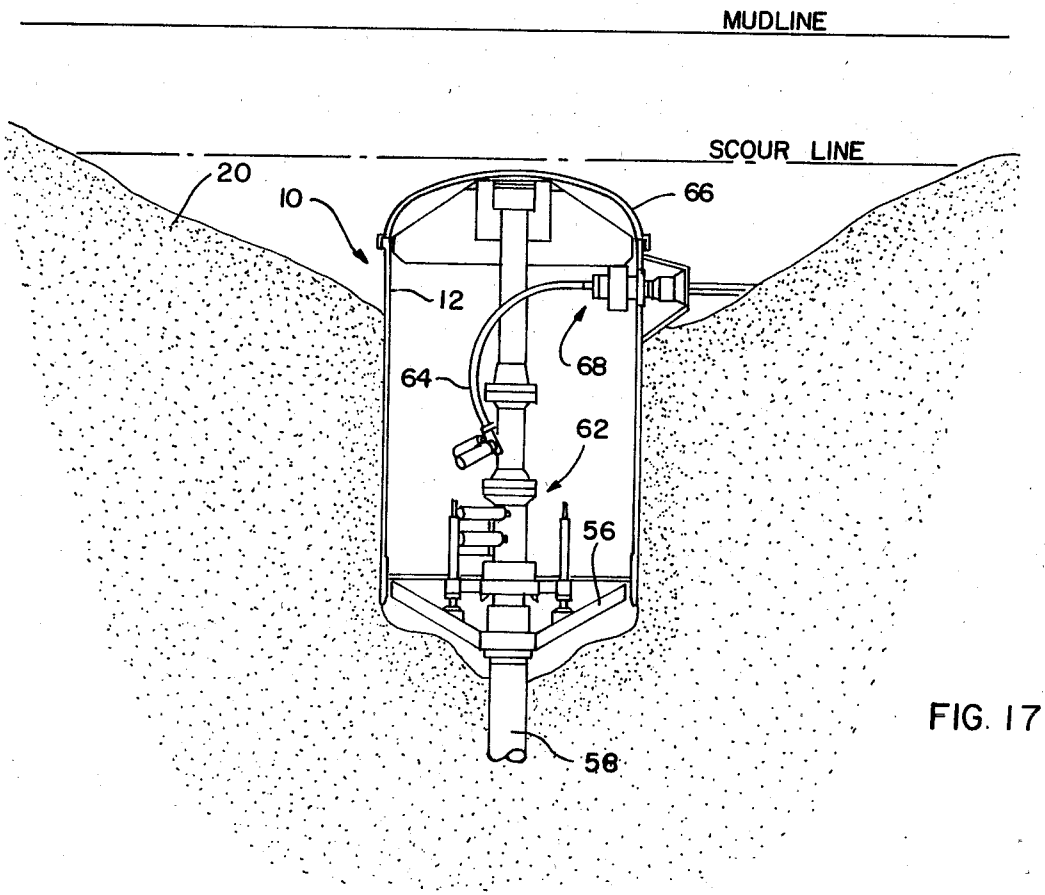

A blowout preventer 60 is then lowered to the wellhead and, with the riser in place as shown in FIG. 16, the well is completed subsequently, a christmas tree 62 is installed on the wellhead as seen in FIG. 17 and flowlines 64 are attached to the tree 62, a debris cover 66 is installed on the top of the caisson and the flowlines 64 passing through a port 68 in the upper side wall of the caisson.

Figure 28:
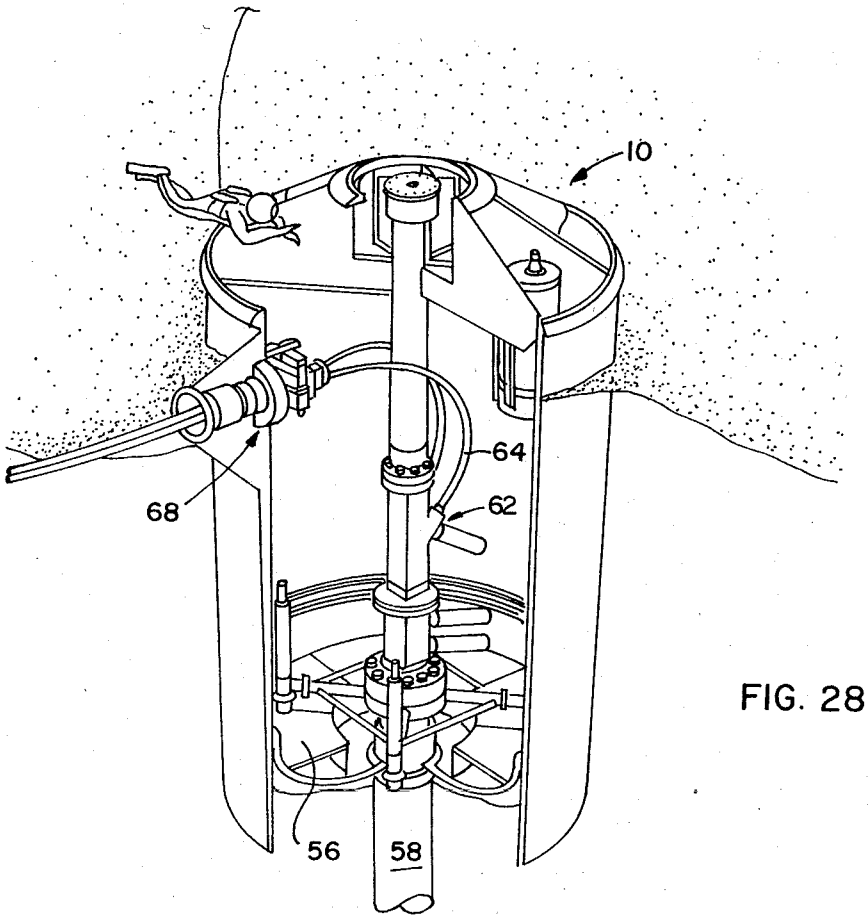
FIG. 28 is a perspective view of a completed subsea well.

The debris cover 66 can be removed for wet access to the wellhead as shown in FIG. 28 llustrating the well completion, or a sealed entrance, not shown, can be applied to the caisson for dry access through submersible vehicles.

Figure 18:
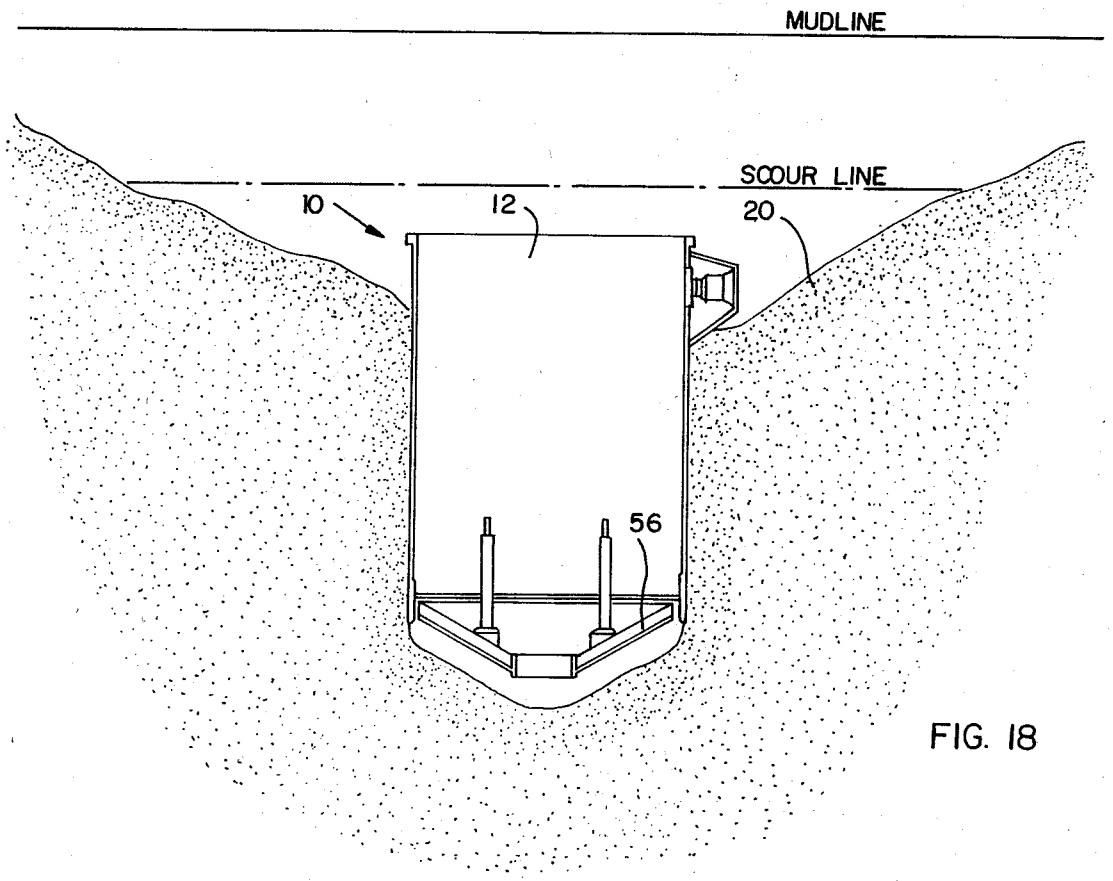
FIG. 18 discloses an embodiment of the invention where a bottom enclosure is installed with a conductor pipe.

The previous sequence of installation drawings shows the bottom closure 56 being installed with the conductor pipe. If necessary, the bottom closure 56 can be installed by the work boat. FIG. 18 shows the caisson 10 after all the silo installation equipment has been removed with the bottom closure in place. The drilling sequence is the same.

Figure 19:
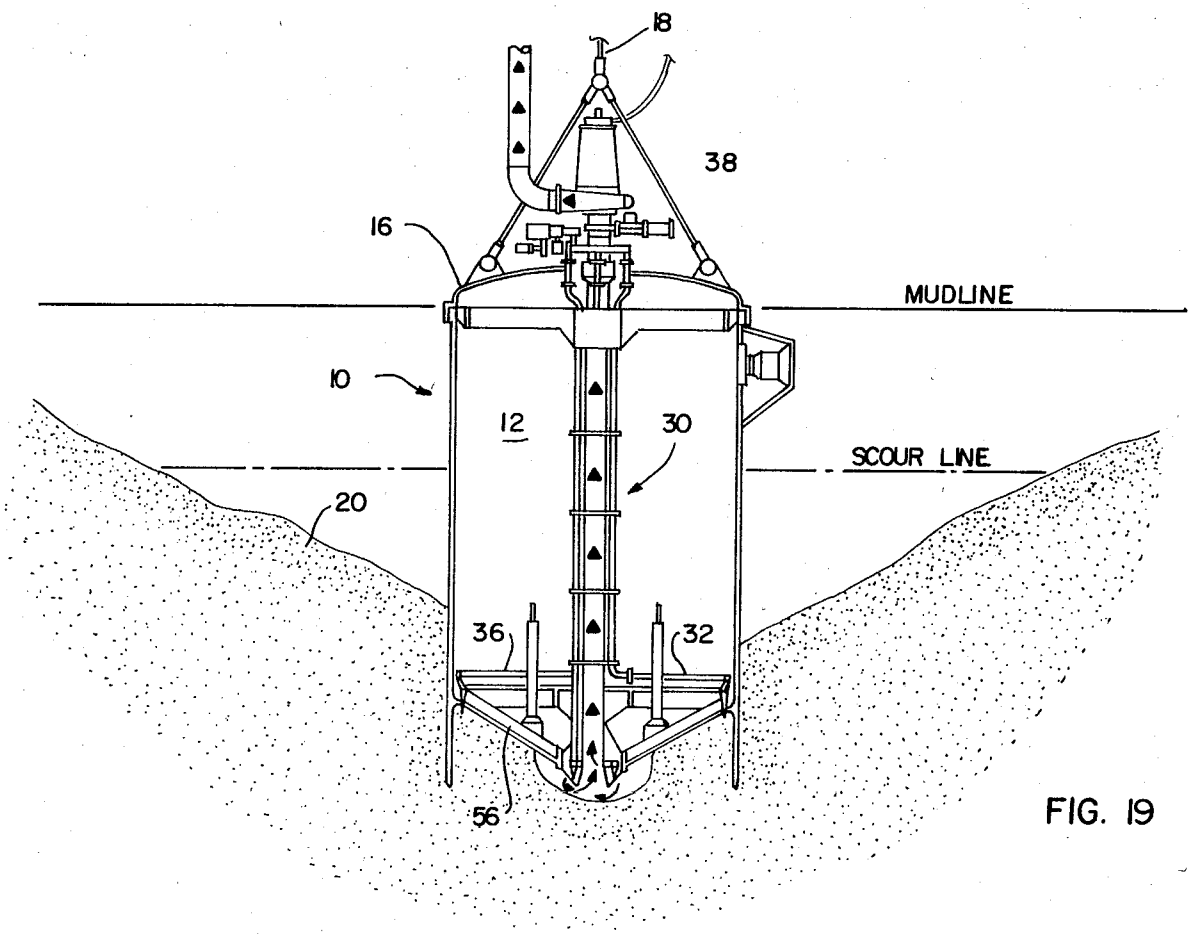
FIGS. 19 through 23 inclusive show an embodiment of the invention where the caisson is installed with the bottom closure in place.
Figure 20:
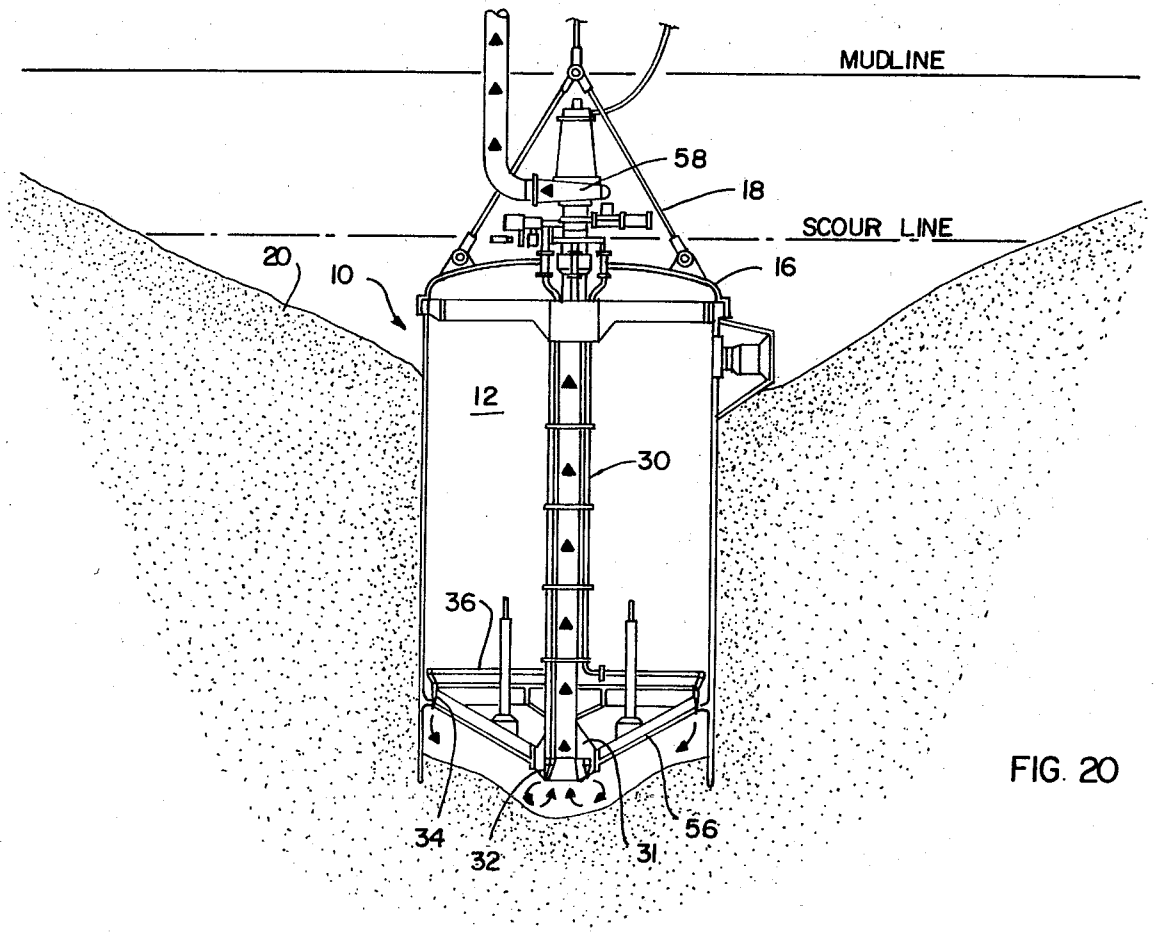
Figure 21:
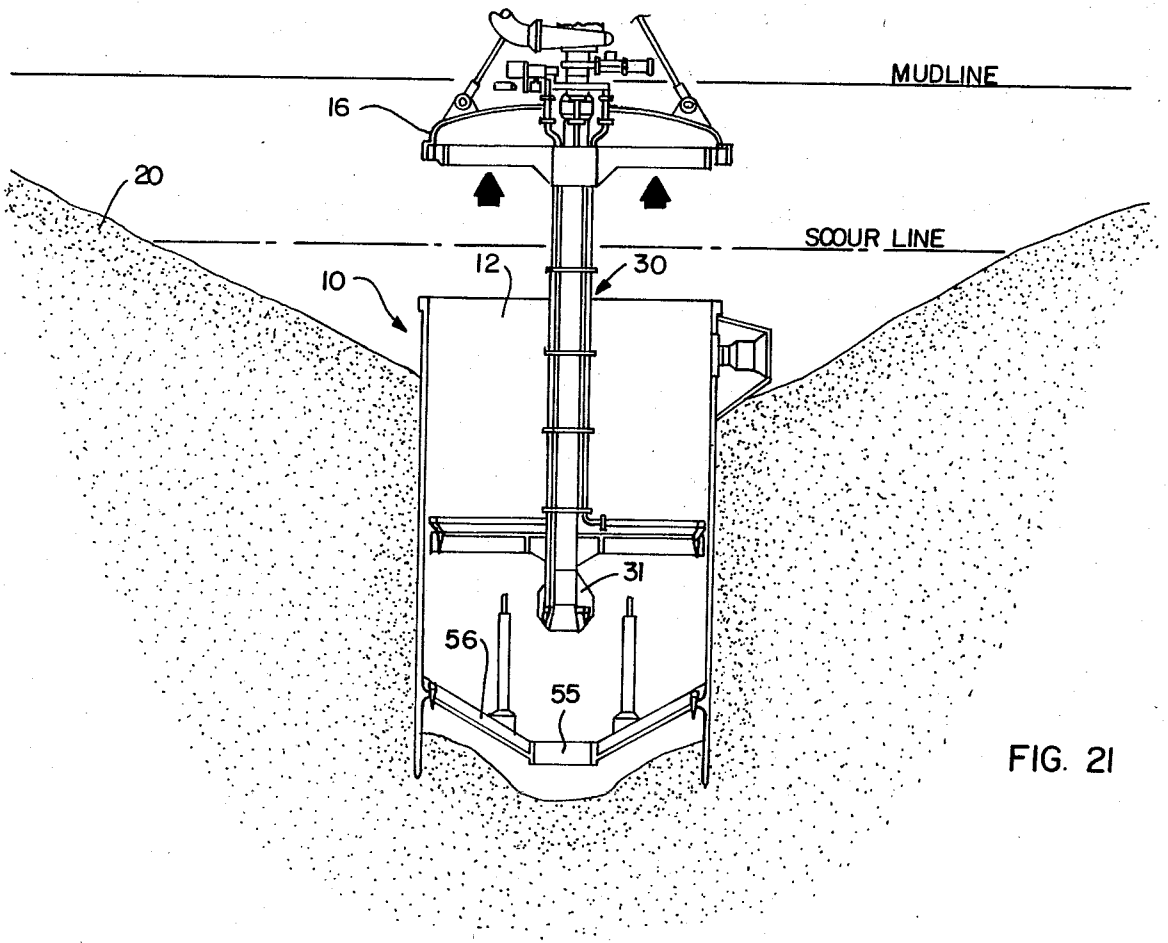
Figure 22:
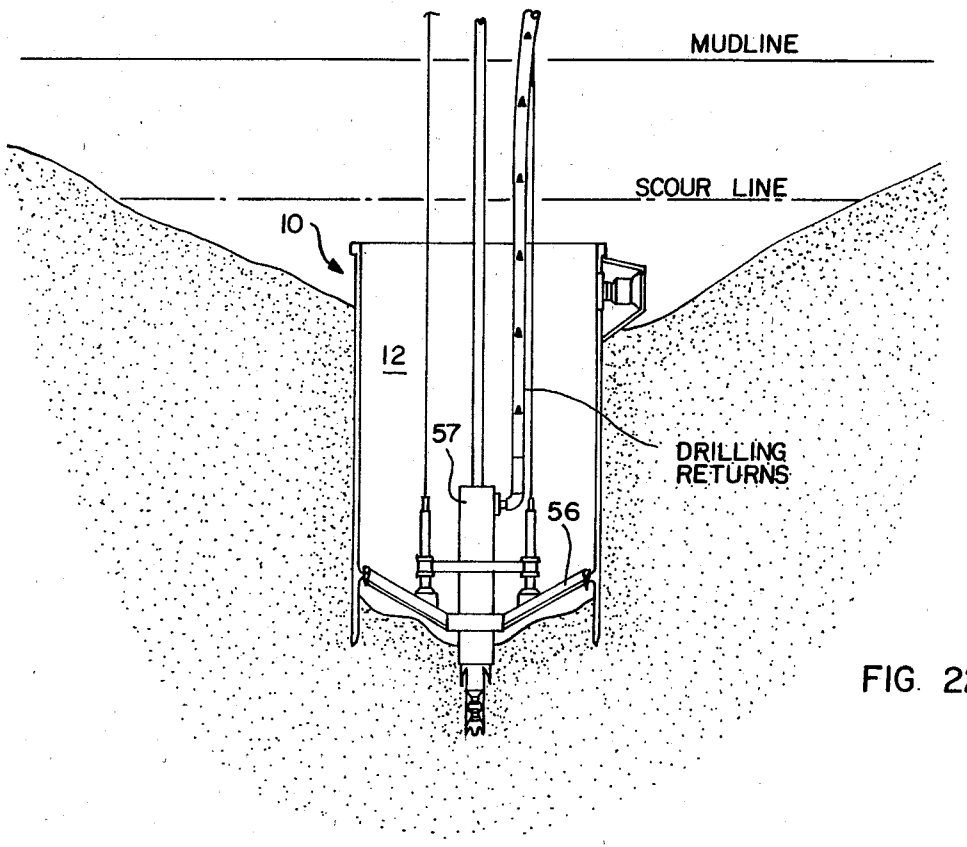
Figure 23:
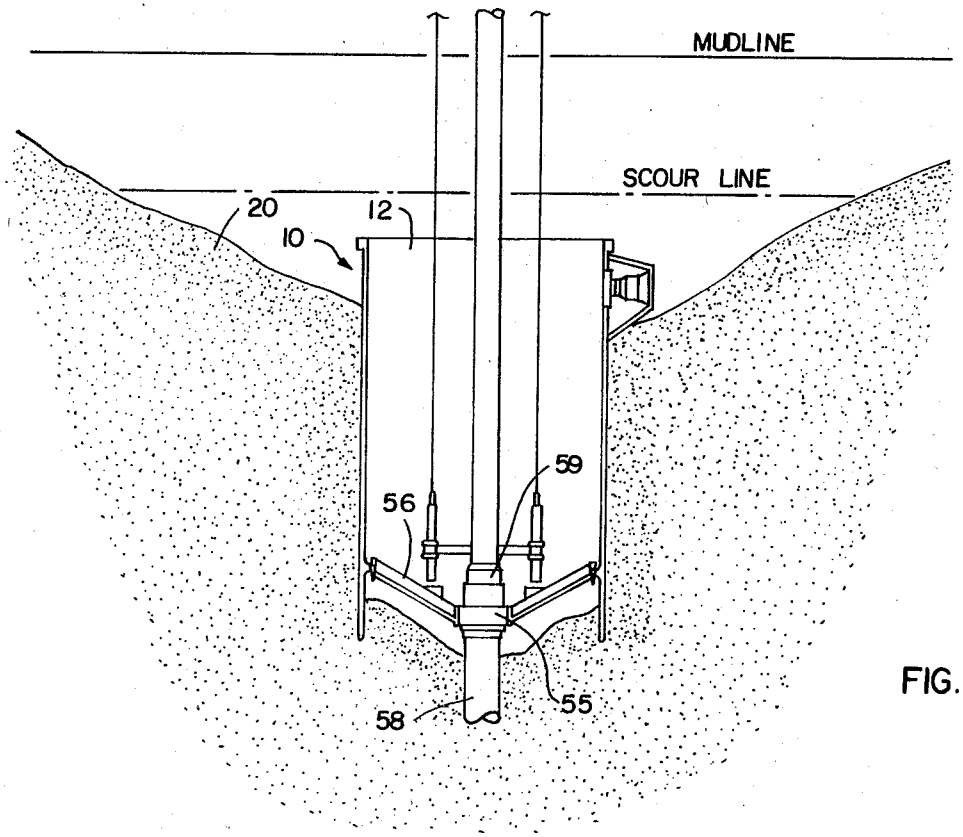

FIGS. 19 through 23 inclusive show the procedure of installation where the caisson 10 has the bottom closure 56 in place. The caisson is lowered to the seabed from the work boat or barge, partially penetrating the seabed 20 under its own weight. The suction pumps and jets of the suction assembly 30 are actuated until the caisson reaches its required depth as shown in FIG. 20. The cover and suction equipment are subsequently removed (FIG. 21) the bit and reamer are lowered into the caisson to drill for the outer conductor. The bit and reamer assembly 57 are then removed and the drilling riser 59 is landed as shown in FIG. 23.

Figure 24:
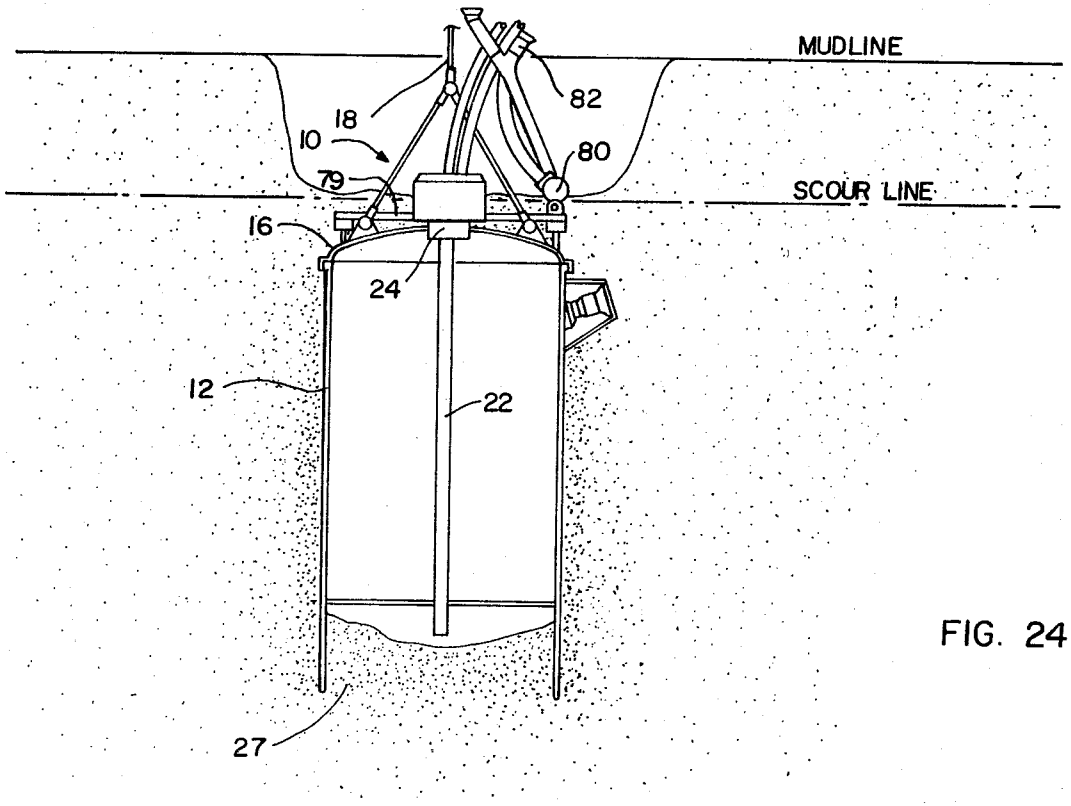
FIGS. 24 and 25 illustrate a variation in the installation procedures.
Figure 25:
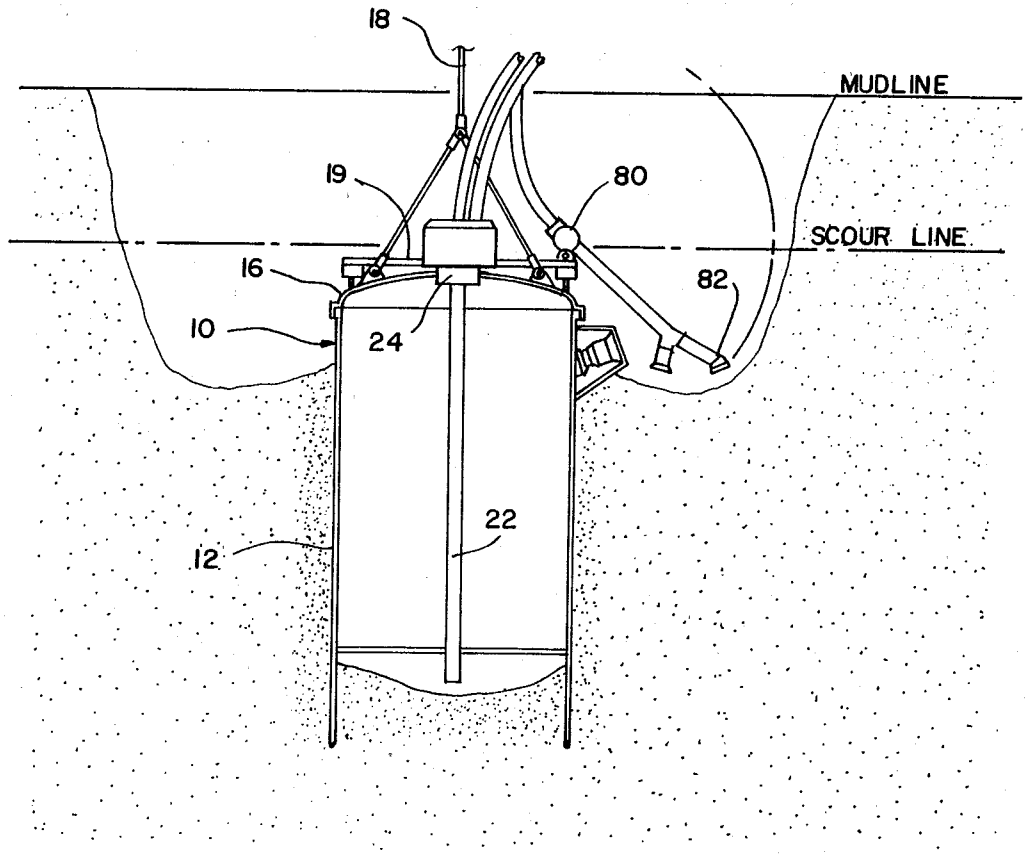

It will be noted that the bottom closure 56 has a central aperture 55 large enough to allow the suction head 31 to pass through (FIG. 20) and subsequently to receive the conductor pipe 58, FIG. 23. In the method of FIGS. 19 and 20 the fluidized soil is removed through the centre of the caisson rather than displacing any soil around the outside. In the embodiments of the invention described before, a shallow glory hole has been made prior to installing the caisson. In FIGS. 24 and 25, the method of installation is shown where a rotating suction head would make a glory hole after the silo installation. The caisson 10 is installed using hydrostatic pressure until it is at its desired location as shown in FIG. 24. A rotating base member 79 is provided with an arm 80 having a pair of suction nozzles 82 and is mounted on the top 16 of the caisson as shown in FIG. 25. Arm 80 and nozzles 82 can be directed along a vertical plane where desired to remove the subsea soil as illustrated when the caisson 10 is installed the suction arm 80 is kept in its most upright position as seen in FIG. 24, when the correct depth is reached below the mudline, the arm 80 is rotated to its FIG. 25 position and the base 79 is rotated about the axis of the caisson.

Figure 26:
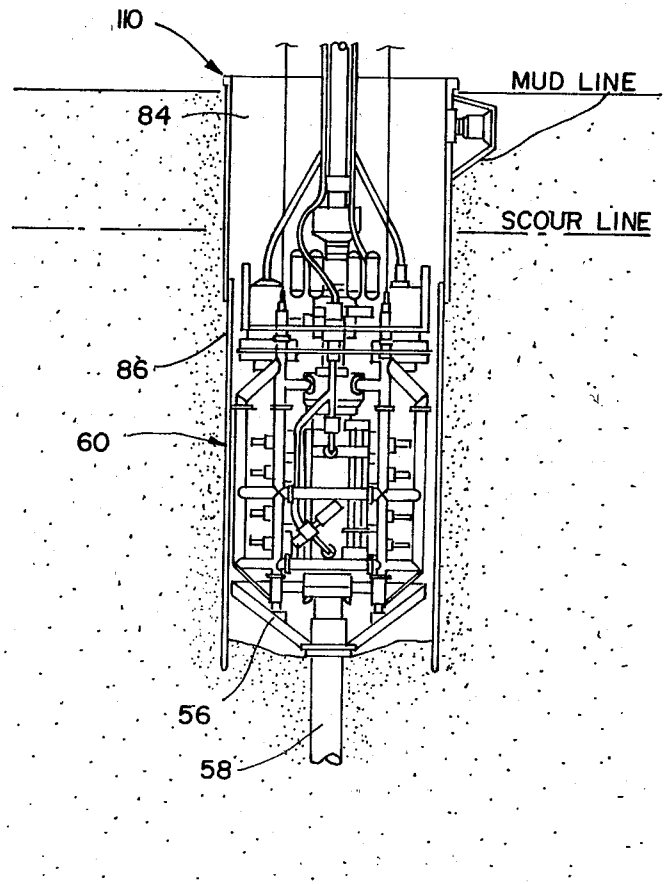
FIG. 26 illustrates a further embodiment of the invention.

In some cases, a shallow glory hole may not be required because scouring may be so infrequent that the caisson can extend all the way to the mudline. This is shown in FIG. 26. This arrangement would also be applicable to deep caissons where it may not be possible to install a long caisson. In this situation, an upper caisson 84 would be installed first in accordance with the procedures described earlier and then lower caisson 86 would be installed through the upper to provide the combined, telescopic form of caisson 110 as illustrated.

Figure 27:
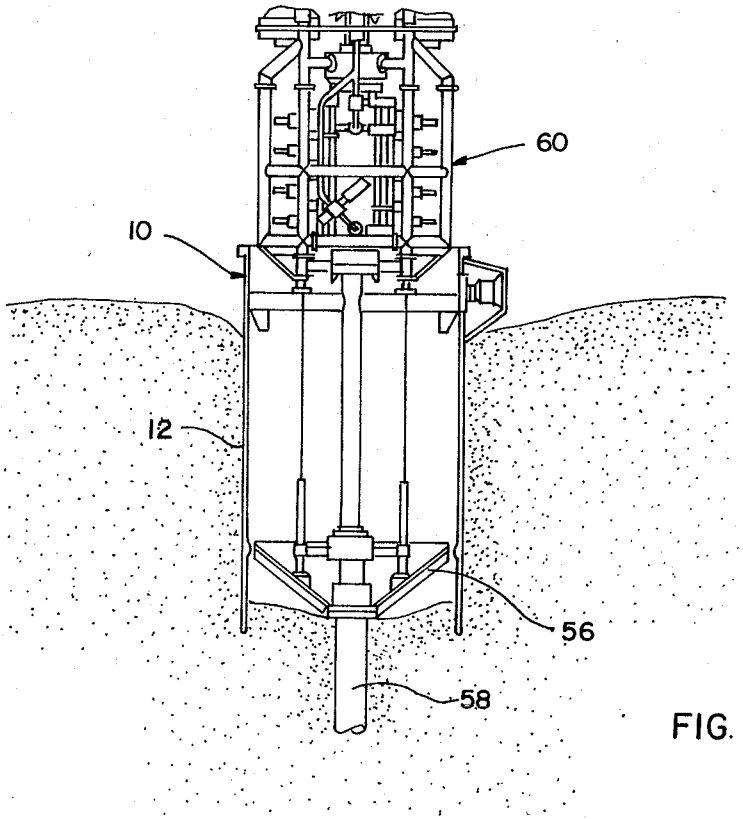
FIG. 27 shows a still further embodiment.

If the risk of damage from scouring is very small then it is also possible that the blowout preventer can remain at the mudline. This arrangement is shown in FIG. 27.

Figure 29:
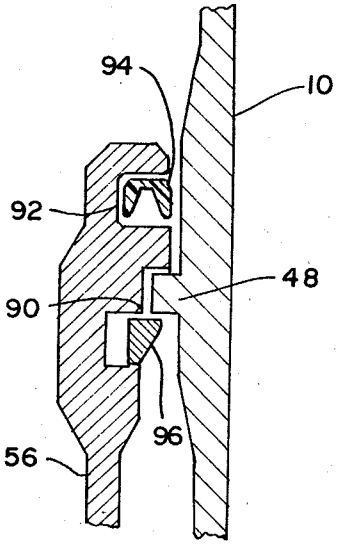
FIG. 29 is a sectional view of the caisson wall showing a locking and sealing detail for the bottom enclosure.

FIG. 29 shows one form of locking and sealing the bottom 56 in the caisson 10. The annular rim of the base 56 includes a shoulder 90 which rests on the inwardly directed lip 48 of the caissn wall and a pocket 92 located above the shoulder encloses an expandable seal 94 which engages the inner wall of the caisson 10 to seal the base therewith. Upward movement of the base is prevented by means of a lock ring 96 engaging the under side of the inwardly directed lip 48.

Figure 30:
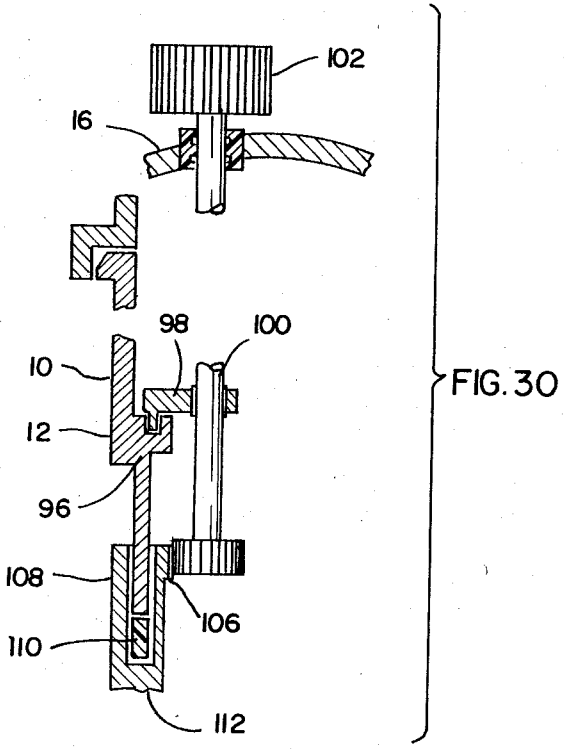
FIG. 30 is a sectional view through the caisson wall showing an arrangement for mounting a cutter on the base of the caisson.

FIG. 30 illustrates an arrangement for applying a cutter to the lower terminal edge of the silo 10 for use in areas where the seabed may provide too much resistance and prevent full penetration of the caisson using only hydrostatic pressure. The cutter would only have to remove a small amount of the soil required for the caisson walls to pass therethrough. Accordingly, the caisson wall 12 may be provided adjacent its lower end with a lip 96 having support means 98 or aligning and supporting a drive shaft 100 which passes downwardly through the top 16 of the caisson from exterior motor means 102. The lower end of the shaft 100 is provided with a pinion gear 104 which engages gear teeth 106 on the inner peripheral rim of an annular cutter body 108 which is mounted for rotation on the lower edge of the caisson wall 12 by means of rollers 110. As seen in FIG. 30, the lower end of the cutter 108 is provided with suitable teeth 112 for cutting into the subsea soil.

Figure 31:
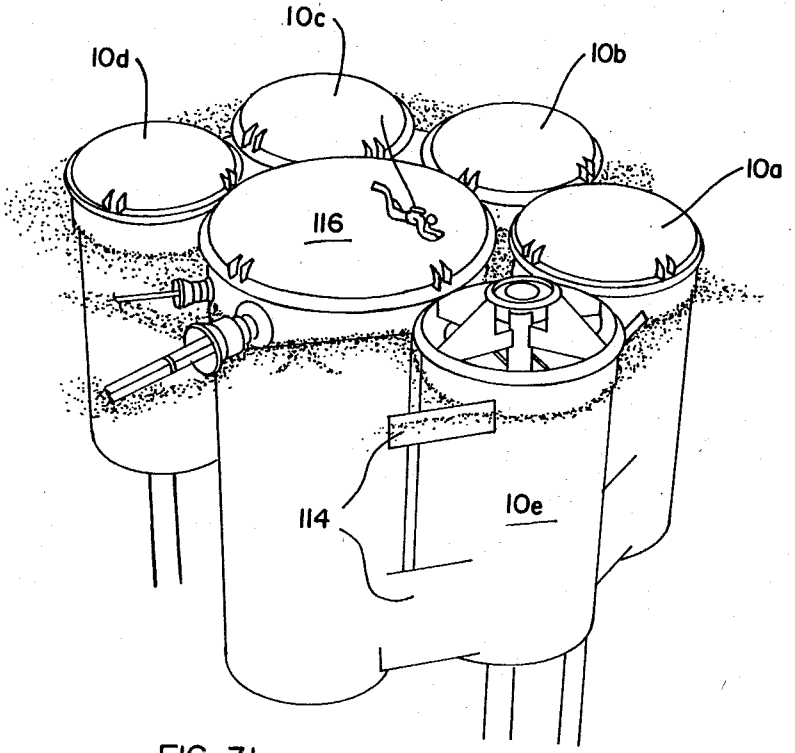
FIG. 31 is a perspective view of a clustered caisson manifold center.
Figure 32:
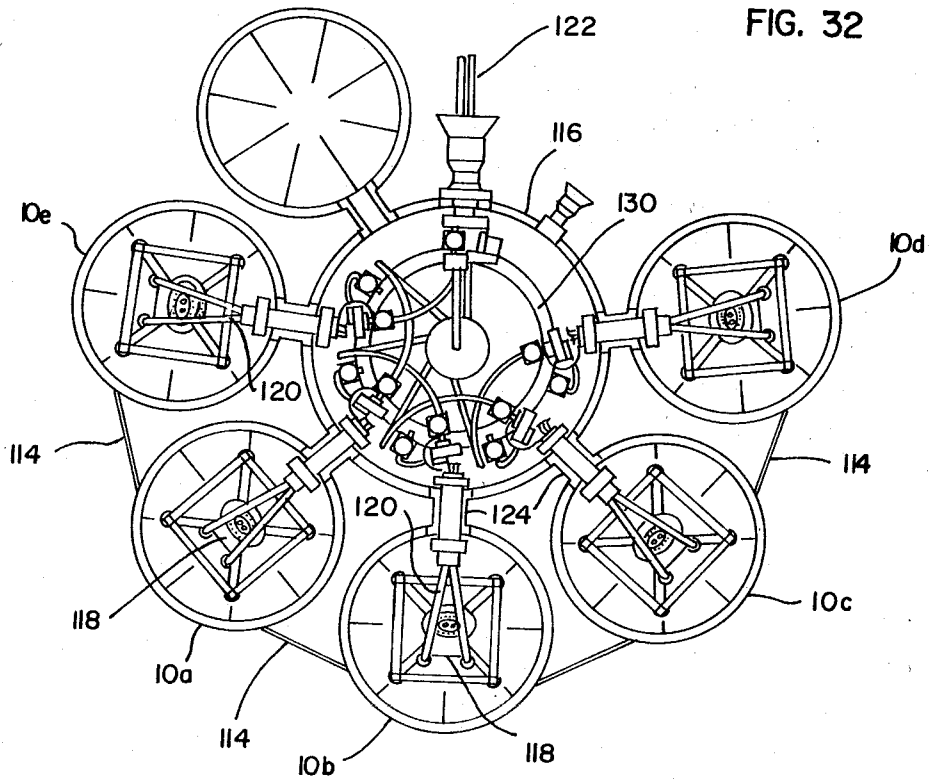
FIG. 32 is a plan view of the cluster shown in FIG. 31.
Figure 33:
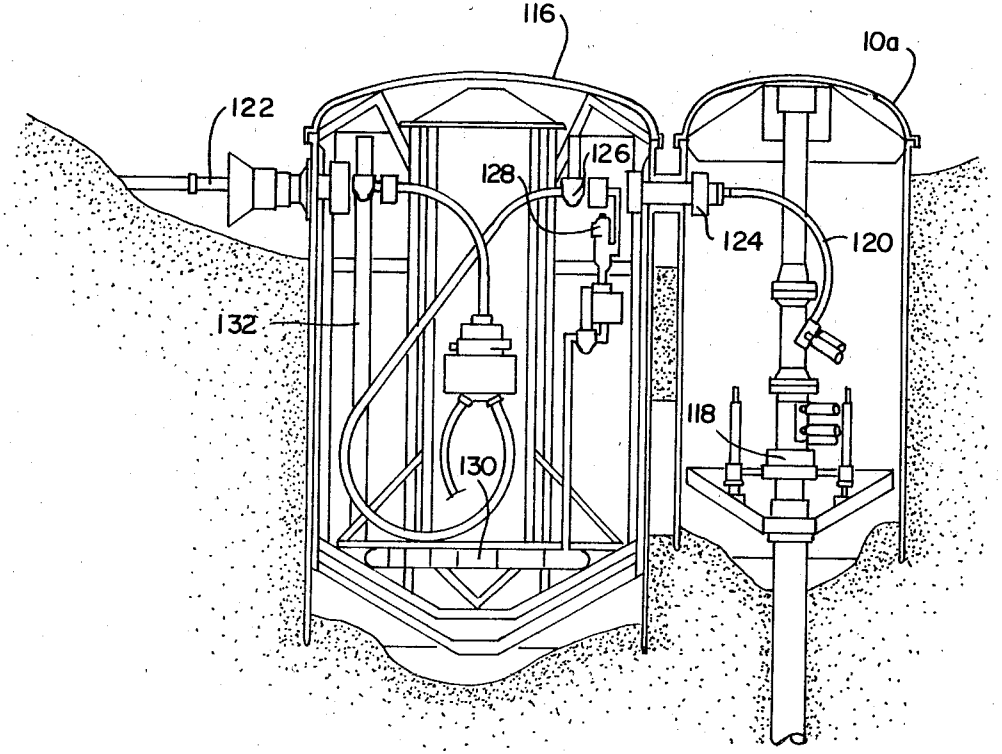
FIG. 33 is a sectional view of a portion of the manifold arrangement shown in FIG. 32.

In many field developments, clustered or template wells are preferred. The present invention is very adaptable to this and FIGS. 31, 32 and 33 show typical clustered and manifolded arrangements. All the caissons are installed as an assembled unit. No mudmats, levelling devices or piles are necessary as would normally be used for a drilling template. Levelling is accomplished by using different suctions in the various caissons.

As seen in FIG. 31, a number of caissons 10A through 10E are joined together by structural tie plates 114 and are interconnected with a central manifold silo 116. Each caisson such as 10A feeds into the manifold caisson 116 through product lines 120, an export flow line 122 delivering the product from the complete assembly. Connectors 124 transmit the product from lines 120 into the manifold caisson 116 through valves 126 and chokes 128 and subsequently into the production line manifold 130. The product subsequently exits through a vertically oriented manifold line 132 to the export flow line 122.

Figure 34:
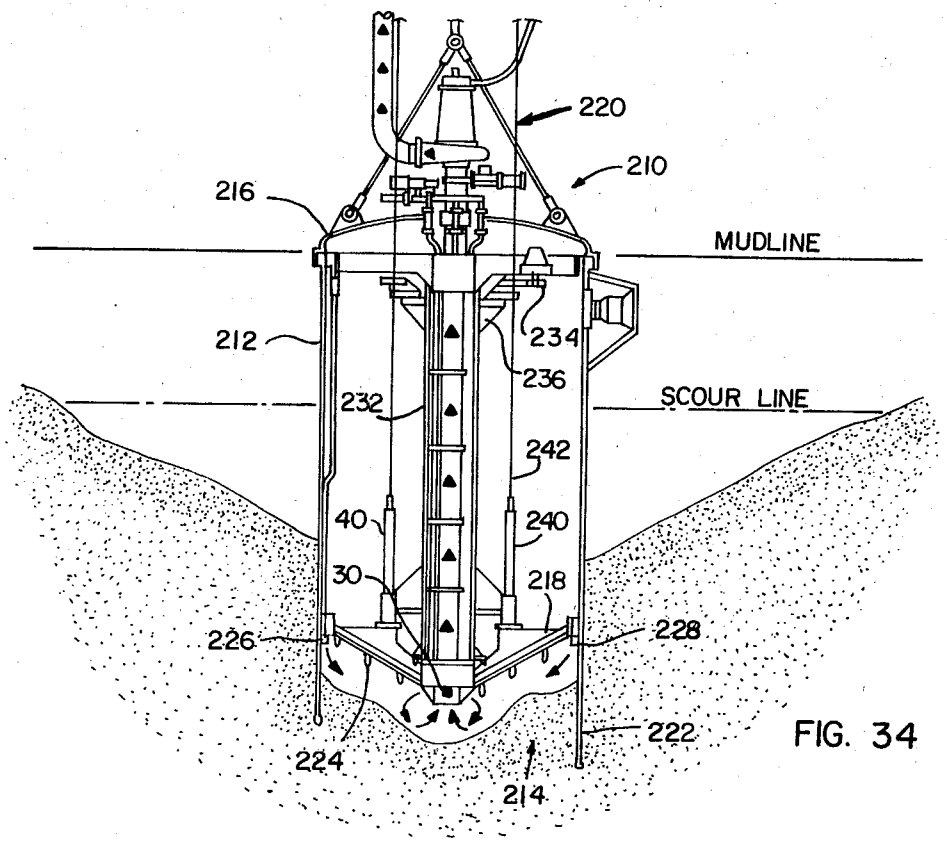
FIGS. 34 and 35 are cross sectional views of a caisson being lowered into the seabed to a required depth and illustrating the interior mechanism for affecting the lowering.
Figure 35:
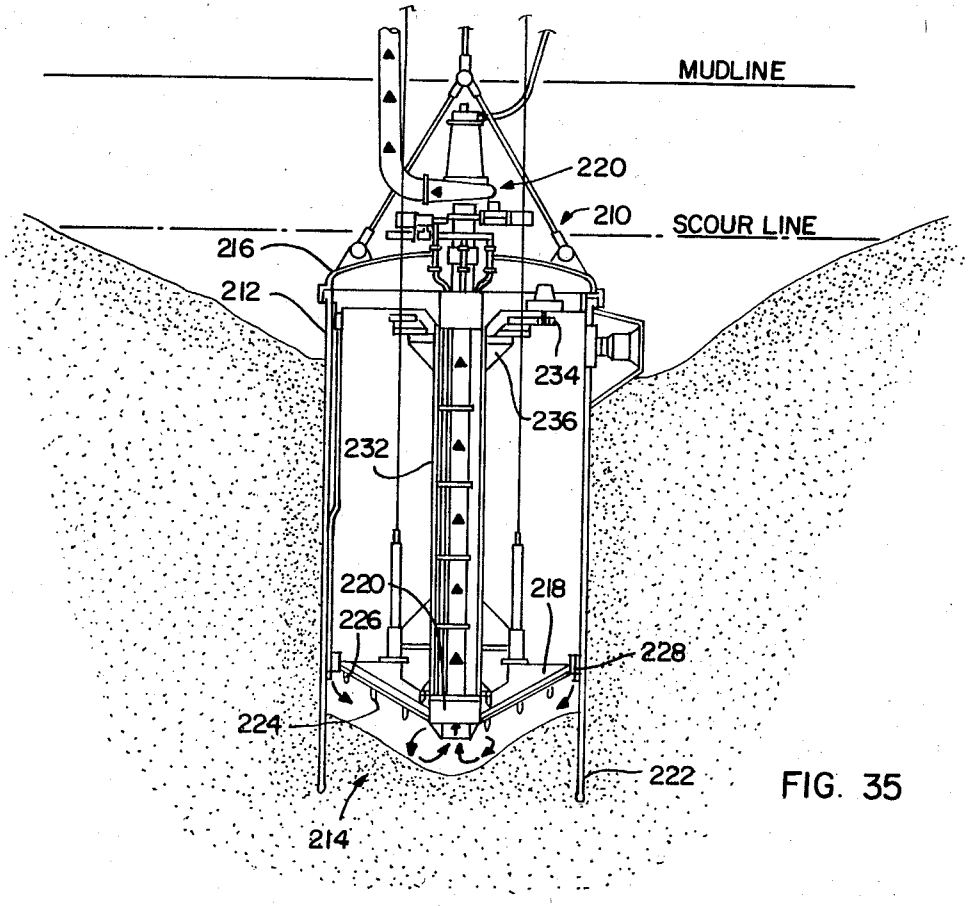

Referring to the embodiment of the invention in FIGS. 34 to 41 and specifically to FIGS. 34 and 35, the subsea caisson indicated generally at 210 consists of an elongated cylindrical body with a continuous curved wall 212, an open bottom 214 and a detachable top closure 216. The caisson 210 has a bottom wall in the form of a conical suction head 218 which includes connections to a dredge pump 220 located on the top of the caisson.

When the caisson is moved to the site, it is gradually flooded and lowered to the seabed. Upon contact, the caisson will penetrate the seabed under its own weight and may initially penetrate the seabed, depending on the soil condition, up to a depth of approximately 4 feet where the suction head or base 218 engages the sea bottom.

Under pressure is then created through the use of the retrievalbe dredge pump 220 situated on the top of the caisson, the pump being designed to be capable of supplying a low head while at the same time discharging a large volume of a soil-water mixture. The pump 220 is started when the caisson has reached its initial penetration of approximately 4 feet. Water jets which are spaced equally around the circumference of the inner wall 212 are oriented radially to direct soil material loosened thereby towards the central suction pipe. A combination of the jetting and the suction removes the soil beneath the base and the caisson sinks further into the soil due to its self weight plus the force supplied by the under pressure. The lower part of the wall 212 of the caisson extends substantially below the base area to provide a skirt 222 to reduce the chances of seepage of surrounding soil into the confines of the lower caisson wall when the soil thereunder is being removed.

Figure 36:
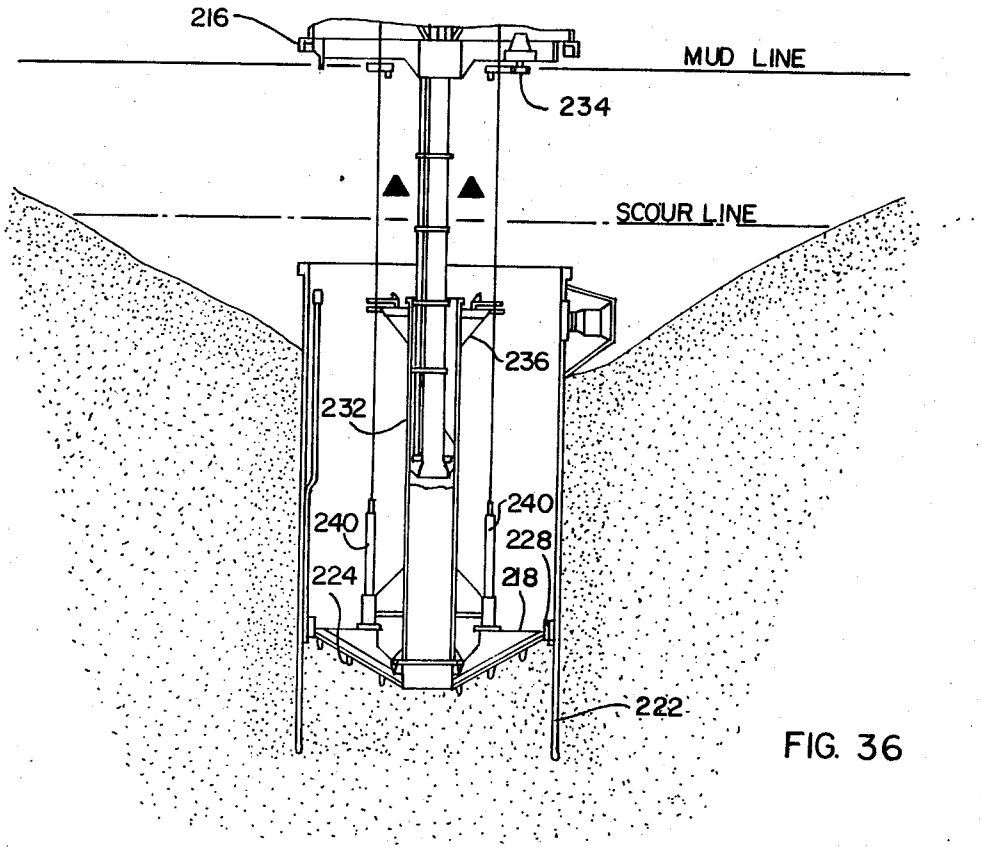
FIGS. 36 and 37 show the cover and suction equipment being removed from the caisson.

The suction head 218 which constitutes the base of the caisson is, as shown in FIGS. 34–36, conical in configuration and located adjacent the bottom of the caisson wall so that when it is installed in the sea bottom by means of lowereing the pressure below the suction head 218, the upper volume of the caisson above the suction head 218 remains void of sea bottom soil. Accordingly, any material or equipment in the upper region of the caisson interior is not subject to damage by abrasion or fouling by soil being stirred up and transported by the jetting and/or suction process. The skirt portion 222 of the caisson wall is made of material of suitable thickness and strength to withstand a full hydrostatic head of the suction process. However, the wall portion 212 above the suction head 218 can be made of a thinner or lower strength material suitable only to withstand the soil pressure gradient.

The suction head 218 is provided on its lower surface with a plurality of radially spaced, steel cutters 224 which are secured to the bottom surface of the head 218 in a spiral pattern so as to cut and transport soil material towards the center of the head 218 assisted by the action of the inwardly directed fluid jets 226. The suction head 218 is mounted for rotation on a plurality of bearing means 228 located on the inner perimeter of the lower area of the caisson wall 212. This perimeter area includes a seal to prevent excessive leakage of pressure and material from the suction cylinder portion of the caisson to the backfill cylinder portion.

Figure 37:
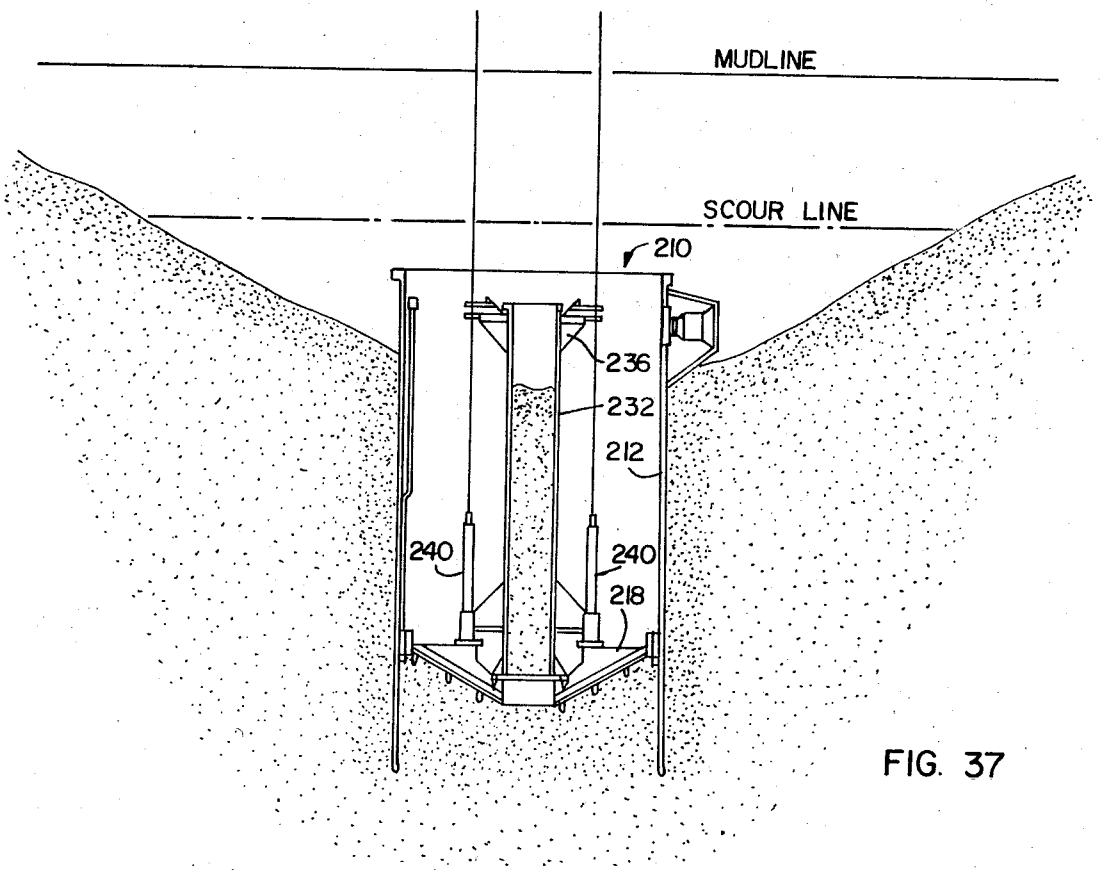

The suction head 230 is connected via a backfill prevention tube 232 which prevents material from below the head from backfilling the caisson and which also acts as a torque tube to transmit power from hydraulic motor means 234 detachably connected to a collar 236 on the upper end of the tube. It would be appreciated that actuation of the motor means 234 will rotate the backfill prevention tube 232 and the suction head 218 to which it is attached. As seen in FIGS. 1 and 2, the suction pump 220 and jets 226, together with the rotary action of the head 218 removes the soil from beneath the caisson and directs it upwardly to the pump 220 and away from the caisson. As shown in FIGS. 356 and 37, the cover 216 and the suction pump 220 and its related equipment are then removed from the interior of the caisson and the backfill prevention tube 232. Standard radius guide posts 240 are provided on the top surface of the suction head 218 to subsequently allow a standard marine wellhead system to be run into the interior of the caisson.

Figure 38:
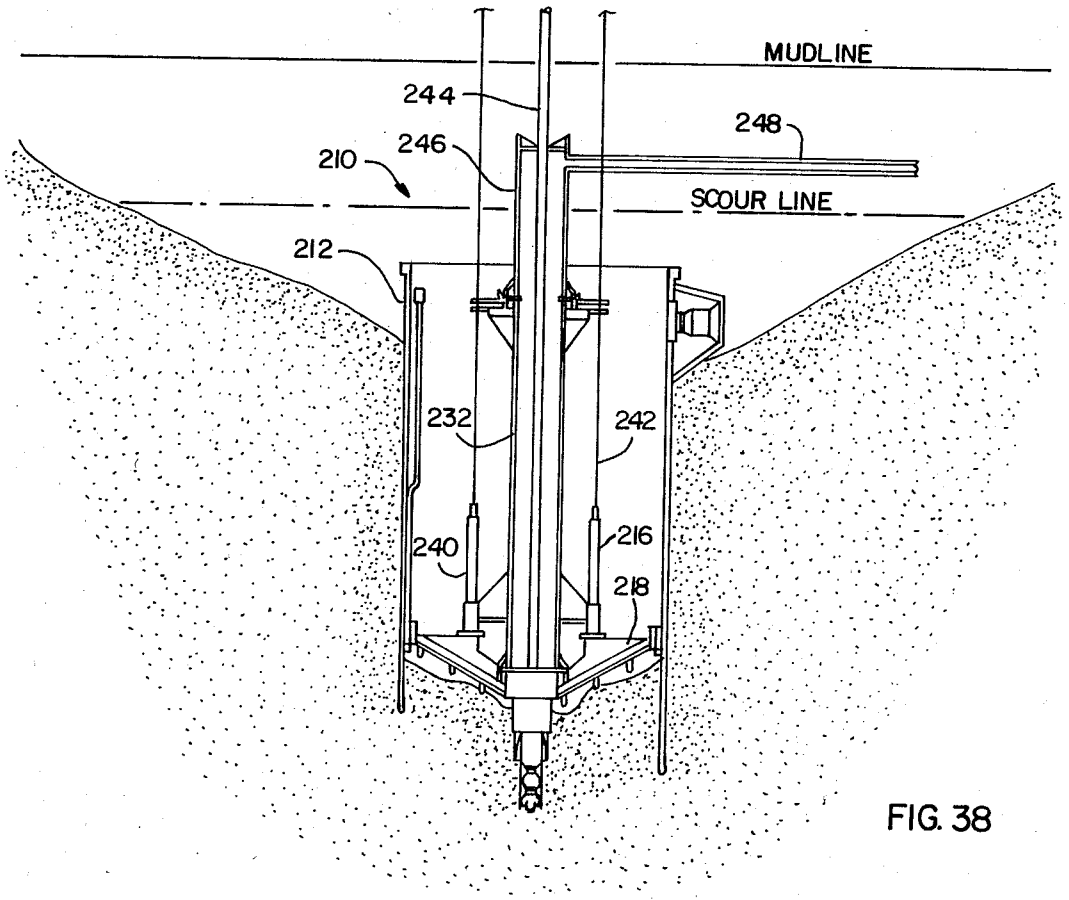
FIG. 38 shows the installation of the drilling means for the outer conductor.
Figure 39:
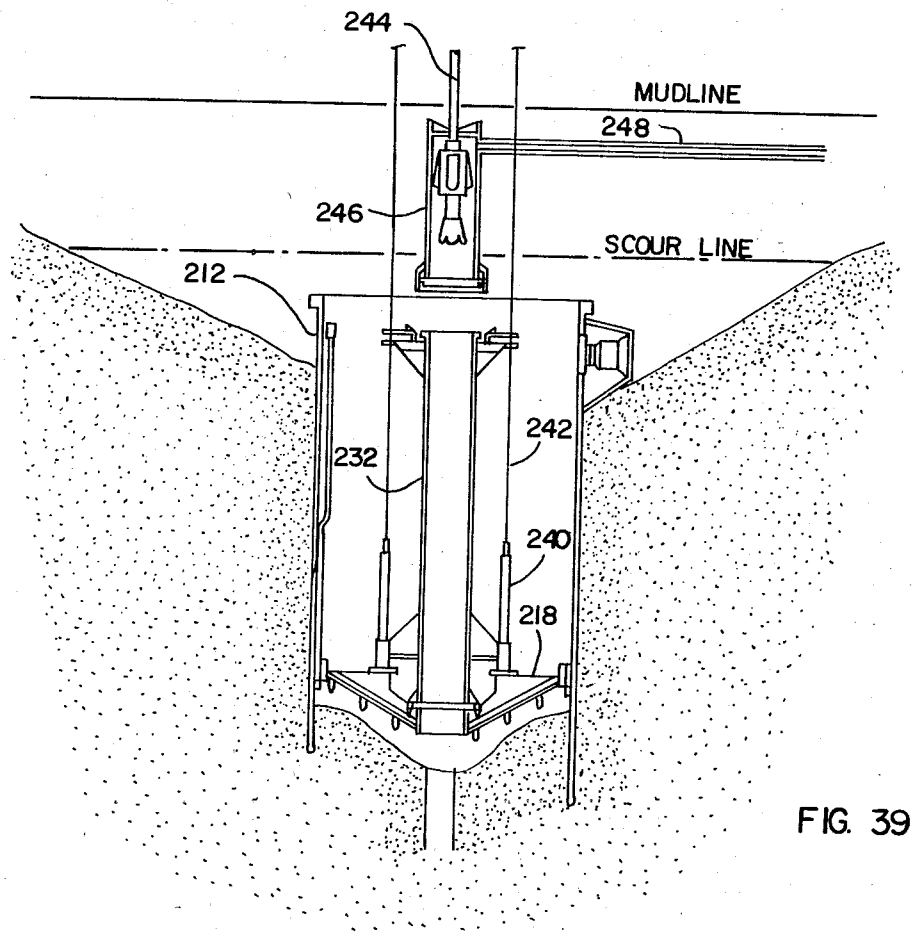
FIG. 39 shows the drilling means being recovered from the silo.
Figure 40:
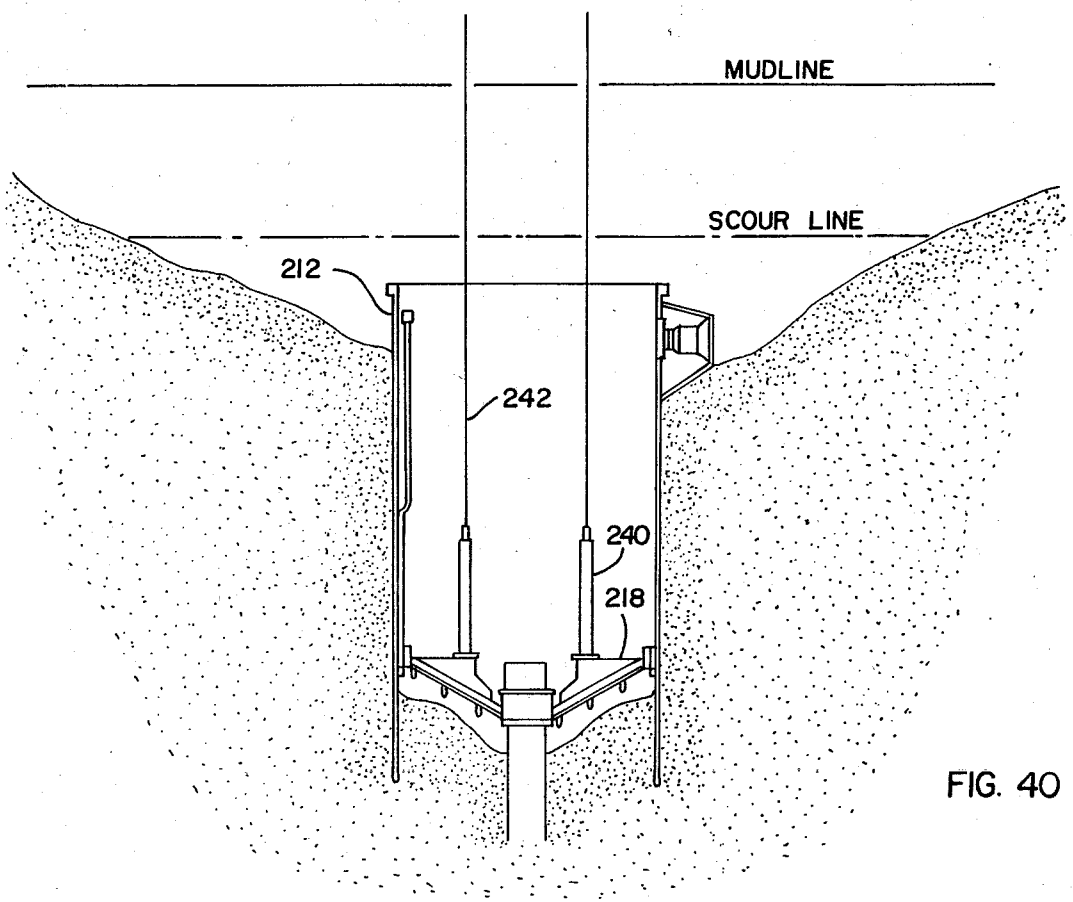
FIGS. 40 and 41 show the backfill prevention tube being removed and a hole being drilled for the inner conductor.

Turning now to FIGS. 38 and 39, drilling through the caisson follows normal practice except that the temporary guide base is not required as the caisson already contains the permanent guide base 218 and drilling and cement returns must be directed out of the caisson.

First, the guide cables 242 are connected to the guide posts 240 on the base 218 and a drill string 244 (FIG. 38) is lowered to the caisson with a returns diverter pipe 246 around the drill string and which rests on the top of the backfill preventer tube 232. The diverter in this way is locked to the base 218 and the drill string proceeds through the tube 232 and commences drilling as shown in FIG. 38. The returns, instead of normally spilling onto the seabed, will continue up the tube 232 and a diverter 246 and, once above the caisson, go through a side extension 248 to be dumped on the seabed. Subsequently, as shown in FIG. 39, the diverter returns to the drill rig with the drill string 244. A conductor is run in the normal way but without the permanent guide base. For cementing, a pipe is provided up the outside of the silo (not shown) to allow cement returns to reach the surface. This is needed not only for visual observation but also to permit extra cement to be pumped in case of channelling.

Figure 41:
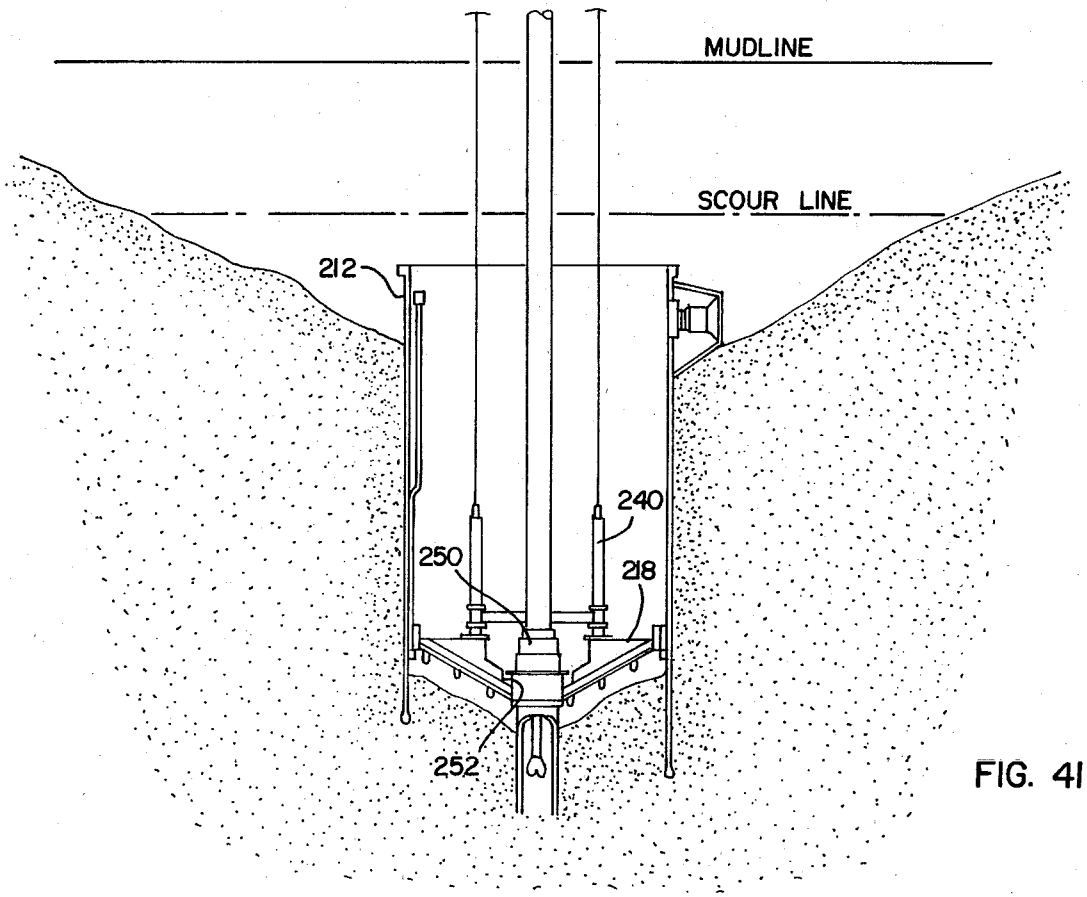
Figure 42:
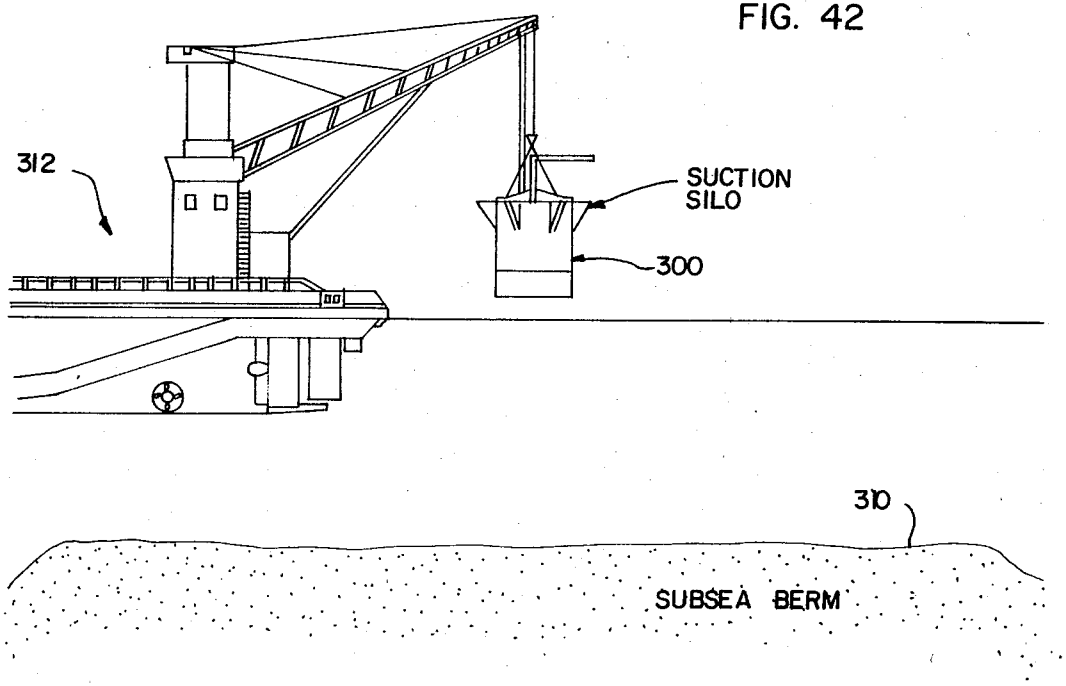
FIGS. 42 through 45 inclusive show the procedure of installing a silo in a subsea berm.

As shown in FIG. 41, drilling the hole for the casing is carried out normally with the riser 250 locking onto the conductor housing 252.

Figure 15:
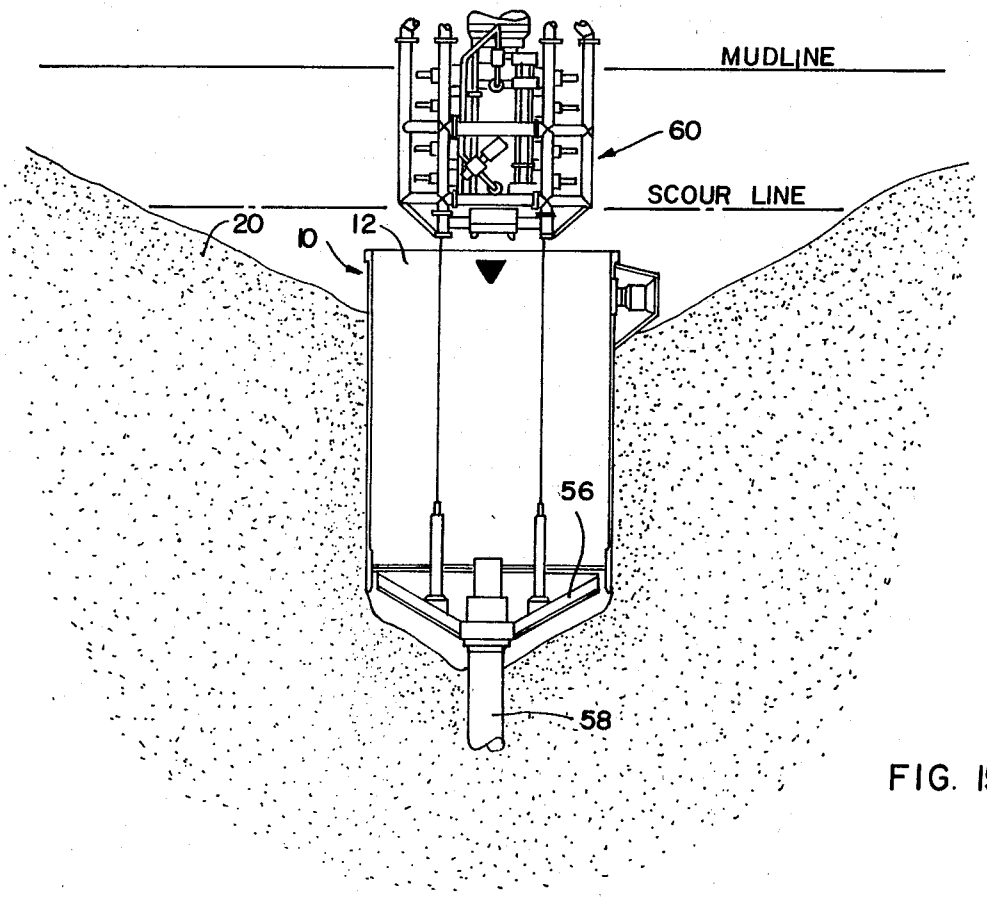

With the casing and wellhead in place, a blowout preventer 54 is run onto the wellhead inside the caisson as seen in FIGS. 15–17. The large diameter of the caisson allows diver access all around the blowout preventer and drilling latter than follows regular practice. Whenever the caisson is not being actively used, a cover can be placed over the top to prevent it from being filled with scoured debris.

A dredge pump used with this invention must be capable of pumping the sea water obtained from 3 sources:

(i) Water trapped below the caisson (say 400 gpm).
(ii) Water supplied by the jets (2000 gpm).
(iii) Water from seepage through the soil around the sides of the caisson.

Seepage flow is a function of soil permeability and the hydraulic gradient. For clean sand to silty sand mixtures, the coefficient of permeability ranges from $10^{-2}$ to $10^{-4}$ in/sec. A flow net constructed to estimate the seepage of water given the hydraulic gradient of 5 ft. water over 10 ft. soil and soil permeability of $K=10^{-2}$ in/sec. gives seepage on the order of 25 gpm.

A dredge pump capable of pumping 2500 gpm of soil/water mixture (S.G. = 1.35) to create an underpressure of 5 psi is required. An example is the Mobile Dredge Pump-size 8"×10"×27½"—AA. The motor supplies 150 hp at 720 rpm. The pump is to be retrievable to the surface after the silo has been installed.

Two Cornell progressive cavity pumps, type 1200 gpm at 300 psi with 325 hp diesel drives, are proposed to supply 16 water jets.

"Quicking" occurs when the seepage force on soil particles by upward flowing water is equal to or greater than the submerged weight of the particles. For typical sands, the critical hydraulic gradient at which quicking begins ranges from 0.8 to 1.2. Calculations show that for an underpressure of 5 psi, quicking will not occur except at local areas near the tip of the silo skirt.

Piping failure is thought to be likely if quicking occurs under the silo base. Under a sufficiently high hydraulic gradient, fine grains are washed out of the soil. Small channels or pipes are created which increase the hydraulic gradient across the remaining intact soil. The resulting seepage forces can now dislodge larger grains. Failure is therefore progressive, starting at the outlet of water flow, working back towards the source. complete piping failure during silo installation would result in the dredge pump ineffectively circulating water with no underpressure (or overpressure) able to be developed.

Both quicking and piping failure must be avoided during silo installation. The silo shell is provided with a 4-ft. skirt to increase the length of soil through which seepage must travel. Underpressures are also restricted to less than 5 psi to lessen the possibility of failure.

In clay soils, the action of the jets alone will not be enough to remove the clay. When the silo reaches the clay layers, the cutters on the rotating base break up the soil and direct it towards the central suction pipe. This is aided by the jets. Because clay has negligible permeability, higher suction pressures can be used without the danger of a piping failure. This higher pressure is needed to overcome the adhesion of the clay against the silo walls.

To install an 18-ft. diameter silo in clay, the following procedure will be followed.

Initial Penetration

Under its own weight, the 18-ft. diameter silo is estimated to penetrate medium stiff clay soil to a depth of 16 ins. The initial penetration creates a seal, allowing underpressure to be applied. A dredge pump creating an underpressure of 10 psi will create a force of 360,000 lbs., driving the silo into the soil after the silo skirt has reached a depth of about 6 feet, the silo base will contact the sea floor. Soil must be removed from below the silo before installation can continue.

Soil Cutting

Installation of the silo in stiff clay soil requires the use of the cutting devices. Preliminary calculations show that the force required to cut and displace a 12-in. swath of stiff clay ½-in. deep is about 300 lbs. With the aid of jetting to direct cut soil towards the central suction pipe, it is determined that a hydraulic motor supplying 3000 ft. lbs. is required. The motor will be retrievable to the surface after installation is complete.

A dredge pump is required to create an underpressure of up to 30 psi and to remove 5000 gpm of 1.35 S.G. water/soil mixture. An example is the Mobile Dredge Pump-size 12"×14"×34"—AA. The motor supplies 350 hp at 600 rpm.

Three Cornell progressive cavity pumps, each supplying 1200 gpm at 300 psi can be used to supply 24 jets. Each pump is equipped with a 325 hp diesel drive.

A Staffa B200 hydraulic motor can be used to drive the 6-ft. radius gear which rotates the silo base and soil cutters. This motor supplies 5000 ft.lbs. torque at 50 rpm for 1500 psi input pressure. Under direct drive, the silo base rotates at about 4 rpm, moving the outside cutters at a speed of about 3 ft/sec.

Berm Wellhead Silo FIGS. 42–45

Figure 43:
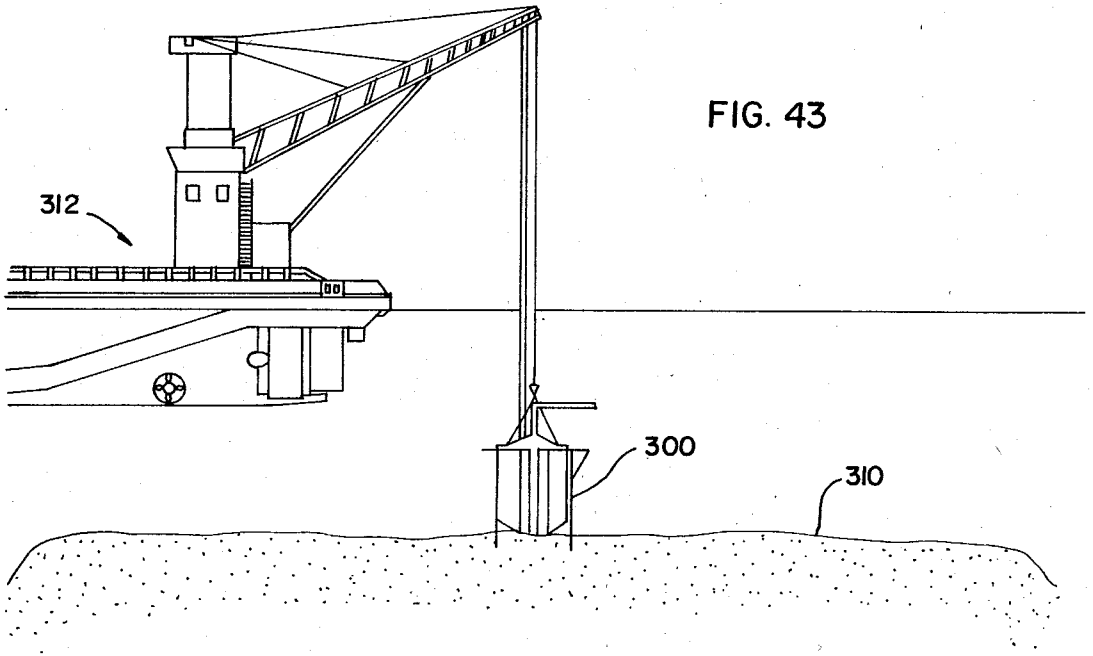

This silo 300 is intended to be installed in a dredged berm 310 where the top of the beam is below sea level and a drilling caisson type of vessel is landed on top of the berm. The silo 300 houses a well disconnection and possibly some type of BOP in case the drilling caisson is pushed off the berm by ice forces. The berm silo is similar to the seabed silo except it is smaller and does not require the rotating cutter head since it will always be installed in sandy material There are two methods of transporting the silo 300 to the drill site. One is by barge or workboat 312, and the other is by towing. Towing is possible because the closures at either end of the silo make it buoyant. When at the site, the silo is gradually flooded and lowered to the seabed. Upon contact with the seabed, the silo will penetrate the seabed under its own weight as seen in FIG. 43.

Figure 44:
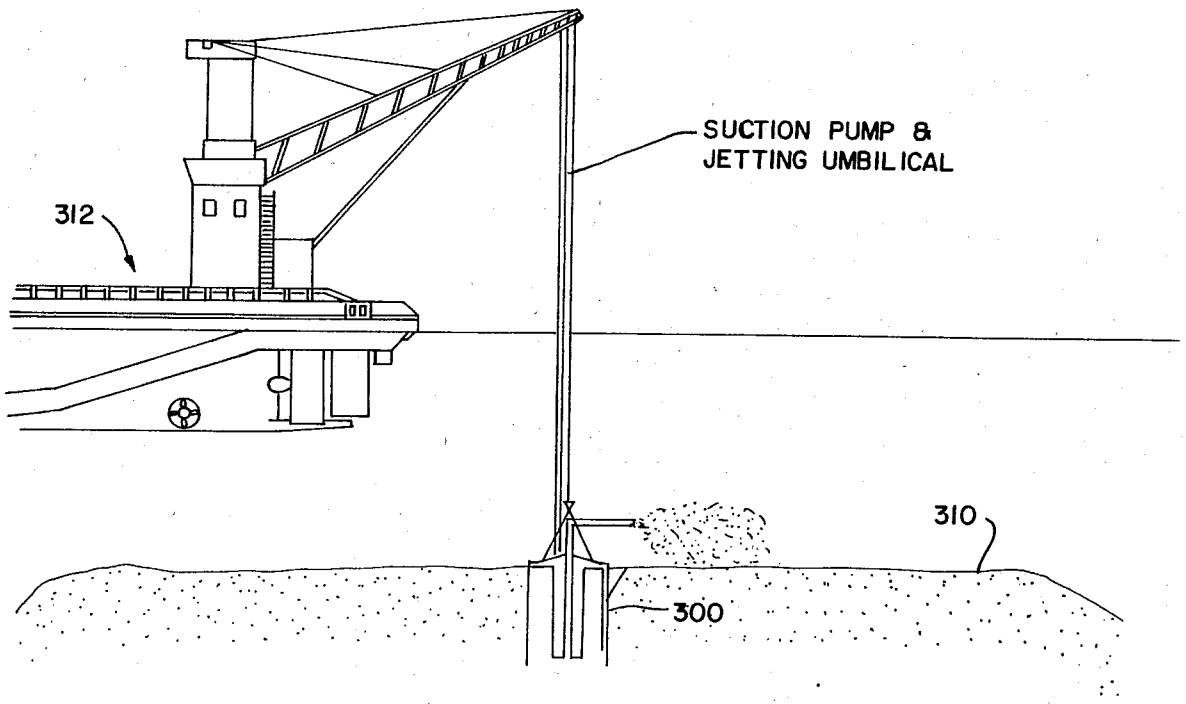

In sandy soils, the suction pumps are started and a low pressure differential used as shown in FIG. 44. The hydrostatic pressure pushes the silo further into the seabed. The pressure and jetting are controlled to ensure that quicking and, eventually, soil piping failures to no occur.

In clay soils, the action of the jets alone will not be enough to remove the clay. When the silo reaches the clay layers, the cutters on the rotating base break up the soil and direct it toward the central suction pipe. This is aided by the jets. Because clay has negligible permeability, higher suction pressures can be used without the danger of a piping failure. This higher pressure is needed to overcome the adhesion of the clay against the silo walls.

Figure 45:
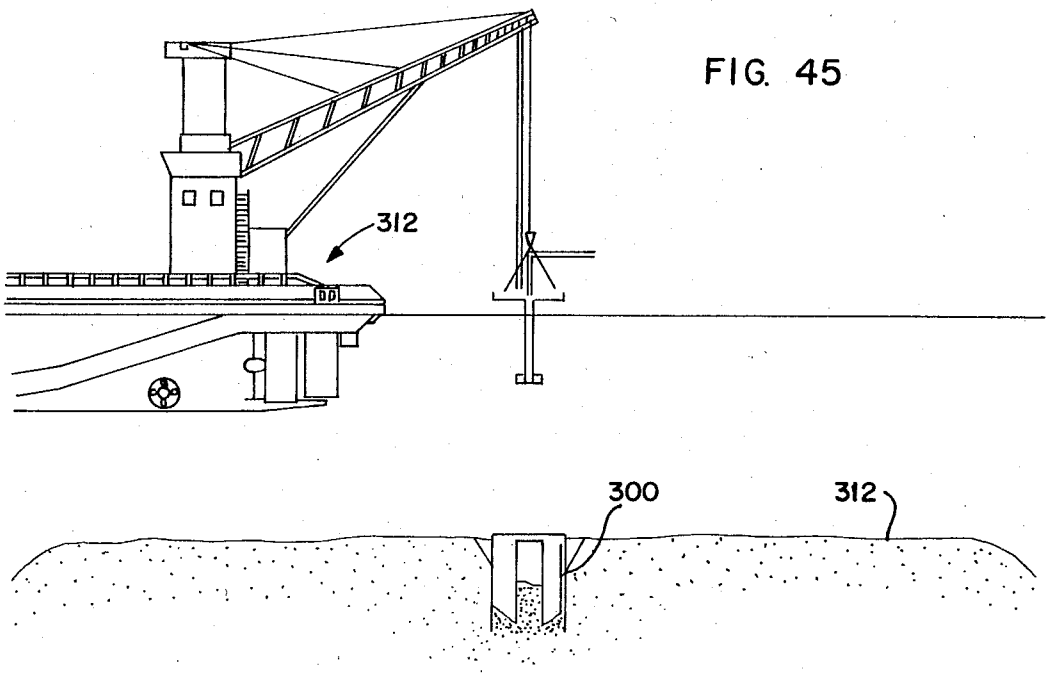

When the silo reaches the required depth, the installation equipment is recovered as illustrated in FIG. 45. If there is danger of fluidized soil entering through the hole provided in the base for the well conductor pipe, the "stand pipe" is left in place and removed after the conductor is set.

Drilling through the silo follows practice, as explained earlier except the temporary guidebase is not required since the silo already contains the permanent guidebase, and drilling and cement returns must be directed out of the silo.

First, the four guide cables are connected to the posts in the base of the silo. The drill string for the 36 inch hole is lowered to the silo with a return diverter pipe around it. The diverter locks to the silo base and the drill string proceeds through and commences drilling. The returns, instead of normally spilling onto the seabed, will continue up the diverter and, once above the silo, go through the side extension to the seabed, away from the silo. The diverter returns to the rig with the drill string.

The conductor is run in the normal way but without the permanent guidebase. For cementing, a pipe is provided up the outside of the silo to allow cement returns to reach the surface. This is needed not only for visual observation but also to permit extra cement to be pumped in case of channeling.

Drilling the 26 inch hole for the 20 inch casing is carried out as normal, with the riser locking onto the conductor housing. Cementing again requires a diverter to prevent the silo from filling with cement returns.

With the 20 inch casing and the 18¾ inch wellhead in place, the BOP is run onto the wellhead inside the silo. The 18 ft. diameter of the silo allows diver access all around the BOP. Drilling through the BOP follows regular practice.

Whenever the silo is not being actively used, a cover can be placed over the top to prevent it from being filled with scour debris.

Figure 46:
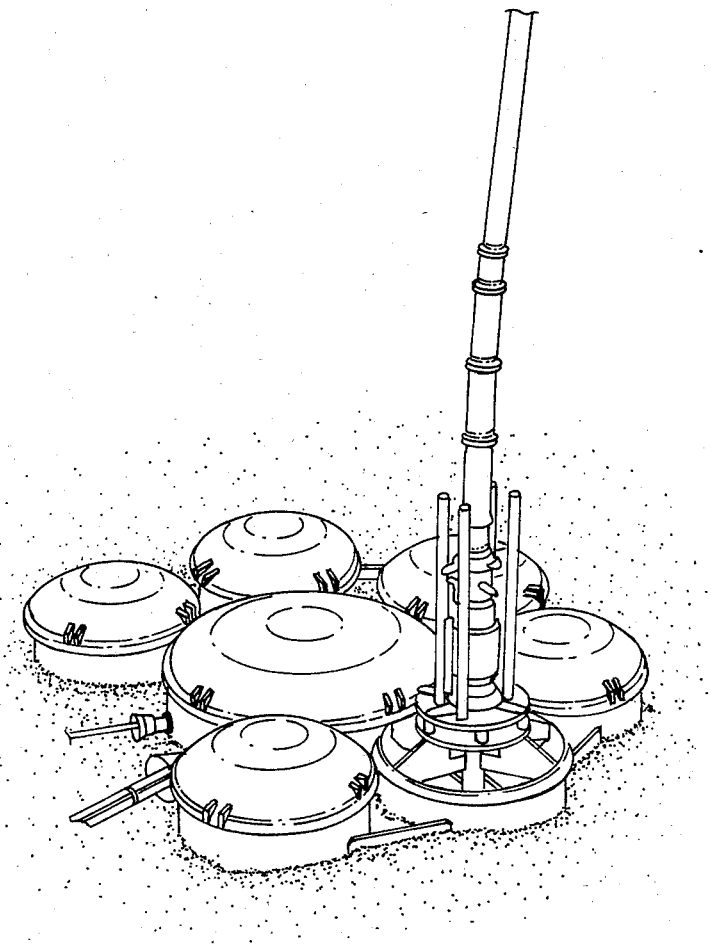
FIG. 46 shows a mean of surface access to a silo well.
Figure 47:
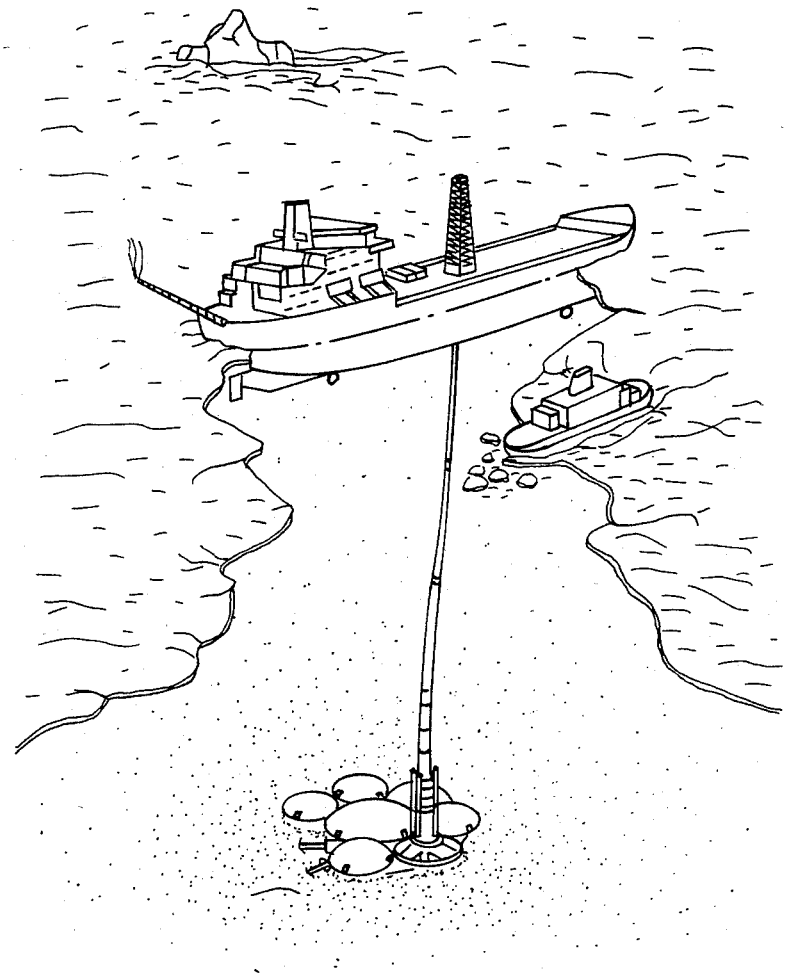
FIG. 47 is a perspective view of a complete subsea production system.

Surface access to the well is shown in FIG. 46 and the completed subsea production system is shown in FIG. 47.

While the present invention has been described in connection with specific embodiments thereof and in specific uses, various modifications will occur to those skilled in the art without departing from the spirit and scope of the invention as set forth in the appended claims.

The terms and expressions which have been employed in this specification are used as terms of description and not of limitation and there is no intention in the use of such terms and expressions to exclude any equivalence of the features shown and described or portion thereof. It is recognized that various modifications are possible within the scope of the invention claimed.

I claim:

1. A method of sinking and securing a caisson in a hole in a seabed, said caisson having a detachable top cover, an open bottom and a removable, self-contained soil-fluidizing and removal means including a plurality of jetting means spaced circumferentially about the inside of the wall of said caisson adjacent the lower end thereof and a suction head located adjacent the lower end of the caisson; said method comprising the steps of:

(a) lowering the caisson to the seabed surface so that the open bottom engages the surface of seabed;

(b) actuating said plurality of jetting means to fluidize said soil in the areas adjacent a lower edge of the inside of the caisson wall and the suction head;

(c) removing said fluidized soil via the suction head from the confines of the caisson during actuation of said jetting means;

(d) forming said hole and sinking said caisson simultaneously to a depth below a predetermined scour line by hydrostatic pressure, said self-contained soil-fluidizing and removal means effecting said forming and said sinking; and (e) removing said top cover and said soil-fluidizing and removal means.

2. A method according to claim 1 including further steps of:

(f) placing a temporary guide in the lower end of said caisson and utilizing said guide for centering a drilling conductor into said seabed;

(g) removing said guide and installing a permanent base in said caisson and attaching a riser to said conductor;

(h) installing a wellhead through said riser; and (i) securing a blow-out preventer onto said wellhead.

3. A method according to claim 1 including the further steps of connecting a flow line through the side wall of the caisson; and installing a debris cover on said caisson.

4. A caisson for installation in a hole in a seabed, said caisson comprising:

(a) an elongated cylindrical housing having a detachable top cover and an open bottom;

(b) a removable, self-contained soil-fluidizing and removal means located within the confines of said cylindrical housing and comprising (1) a plurality of jetting means spaced circumferentially inside of the caisson wall adjacent a lower end thereof; (ii) a suction head located substantially central of the lower end of said caisson; and (iii) jetting means associated with said suction head;

(c) said circumferentially spaced jetting means and said jetting means associated with said suction head combining, when actuated with said suction head, to fluidize the subsea soil in the areas adjacent a lower inner edge of the caisson wall and centrally of the caisson for removal of the subsea soil from within confines of the caisson through said suction head;

(d) said removable self-contained soil-fluidizing and removal means simultaneously forming said hole in said seabed and causing said caisson to sink therein by hydrostatic pressure to a depth below a predetermined line; and (e) means on the inner wall of said caisson for locking and sealing a permanent base therein.

5. A caisson according to claim 4 wherein the circumferentially spaced jetting means of the soil-fluidizing and removal means are directed angularly inwardly of said caisson wall.

6. A caisson according to claim 4 including a bottom closure for said caisson, said bottom closure provided with a central aperture therein so as to permit passage therethrough of the suction head of said soil-fluidizing and removal means and a centrally located well conductor.

7. A caisson according to claim 4 including a disc cutter mounted circumferentially on the lower terminal end of the caisson wall and means for rotating said cutter relative to said caisson about said lower terminal end.

8. A caisson according to claim 4 wherein the replaceable top closure comprises a first closure for use in installing the caisson in the seabed, a second closure for use as a debris cover subsequent to said installation and a third cover for converting said caisson to a one-atmosphere dry chamber including suitable marin mating surfaces between said third cover and an upper edge of said caisson wall.

9. A caisson according to claim 4 including a flowline exit on the upper side wall of the caisson body.

10. A caisson according to claim 4 wherein said circumferentially spaced jetting means are arranged in separate manifold groupings, selective jetting means actuated or deactivated to provide more or less assistance to caisson penetration and to produce a moment to provide vertical installation of said caisson in said seabed.

11. A method of sinking and securing a caisson in a hole in a seabed, said caisson having an elongated cylindrical body, a detachable top cover, a bottom edge, a removable, self-contained soil-fluidizing and removal means including a plurality of jetting means spaced circumferentially inside of a wall of said caisson adjacent a lower end of the caisson and a suction head located centrally of and adjacent the lower end of the caisson; a bottom wall mounted in the caisson adjacent the lower end thereof for rotation with respect to said caisson; and a plurality of cutting means on the lower surface of said bottom wall; said method comprising the steps of:

(a) lowering the caisson to the seabed so that said bottom edge engages said seabed;

(b) simultaneously (i) rotating said bottom wall and said cutters with respect to said caisson to cut into the surface of said seabed, (ii) actuating said plurality of jetting means to fluidize said soil in the areas adjacent the lower edge of caisson wall, the cutters of the bottom wall and the suction head; and (iii) removing said fluidized soil via the suction head from the confines of the caisson;

(c) simultaneously forming said hole and sinking said caisson therein by said self-contained soil-fluidizing and removal means and said rotatable bottom to a depth below a predetermined level of said seabed by utilizing hydrostatic pressure; and (d) removing said top cover and said soil-fluidizing and removal means.

12. A caisson according to claim 6 including a conductor guide located centrally of the base and a backfill prevention tube connected thereto and extending upwardly and centrally of the caisson to prevent material from below the base from backfilling the caisson.

13. A subsea caisson for installation in a seabed comprising, an elongated cylindrical housing having a removable top and a base mounted for rotation inwardly of the lower end of the cylindrical body, said base having a plurality of cutters on its lower surface for engaging the surface of the seabed; bearing means on the inner wall of said caisson mounting said base means thereto; a water jet manifold ring and a plurality of jet means mounted on the caisson wall below said base.

14. A subsea caisson according to claim 13 including a backfill tube and conductor guide located centrally of the base and a backfill prevention tube connected thereto and extending upwardly and centrally of the caisson to prevent material from below the base from backfilling the silo.

* * * * *